US008973990B2

(12) United States Patent
Krupiczewicz et al.

(10) Patent No.: US 8,973,990 B2
(45) Date of Patent: Mar. 10, 2015

(54) CHAIR ASSEMBLY

(71) Applicant: Steelcase Inc., Grand Rapids, MI (US)

(72) Inventors: Todd D. Krupiczewicz, Alto, MI (US); Jeffrey A. Hall, Grand Rapids, MI (US); Gordon J. Peterson, Rockford, MI (US); Dale M. Groendal, Jenison, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/029,284

(22) Filed: Sep. 17, 2013

(65) Prior Publication Data

US 2014/0077541 A1 Mar. 20, 2014

Related U.S. Application Data

(63) Continuation of application No. 29/457,263, filed on Jun. 7, 2013, now Pat. No. Des. 707,976.

(60) Provisional application No. 61/703,677, filed on Sep. 20, 2012, provisional application No. 61/703,667, (Continued)

(51) Int. Cl.

| | |
|---|---|
| ***A47C 31/02*** | (2006.01) |
| ***A47C 31/11*** | (2006.01) |
| ***A47C 7/02*** | (2006.01) |
| ***A47C 7/18*** | (2006.01) |
| ***A47C 7/24*** | (2006.01) |
| ***A47C 1/024*** | (2006.01) |
| ***A47C 7/40*** | (2006.01) |

(52) U.S. Cl.

CPC ..... *A47C 31/11* (2013.01); *A47C 1/024* (2013.01); *A47C 7/02* (2013.01); *A47C 31/02* (2013.01); *A47C 7/40* (2013.01)

USPC ..... 297/218.1; 297/228.11; 297/452.14; 297/452.57; 297/452.58; 297/452.59; 297/452.6

(58) Field of Classification Search

USPC ..... 297/218.1, 218.2, 218.3, 218.5, 228.11, 297/452.14, 452.27, 452.48, 218.4, 452.56, 297/452.57, 452.58, 452.59, 452.6

See application file for complete search history.

(56) References Cited

U.S. PATENT DOCUMENTS

| | | | |
|---|---|---|---|
| 1,782,815 | A | 11/1930 | Fry |
| 2,258,119 | A | 10/1941 | Hipsley et al. |

(Continued)

FOREIGN PATENT DOCUMENTS

| | | |
|---|---|---|
| DE | 3629883 | 3/1988 |
| EP | 0033779 | 8/1981 |

(Continued)

*Primary Examiner* — Rodney B White

(74) *Attorney, Agent, or Firm* — Price Heneveld LLP

(57) ABSTRACT

A chair component that includes a first chair member that includes a forwardly facing front surface and a rearwardly facing rear surface that define a first thickness therebetween, and at least one raised portion extending rearwardly from the rear surface, wherein the front surface and the at least one raised portion define a second thickness therebetween that is greater than the first thickness, and wherein a majority of the first chair member comprises the first thickness; a cover member wrapped about at least a portion of the first chair member; and a drawstring operably coupled with the cover member to draw the cover member about the at least a portion of the first chair member, wherein the drawstring is secured to the first chair member by at least one fastener that is received within the raised portion.

20 Claims, 23 Drawing Sheets

Related U.S. Application Data filed on Sep. 20, 2012, provisional application No. 61/703,666, filed on Sep. 20, 2012, provisional application No. 61/703,515, filed on Sep. 20, 2012, provisional application No. 61/703,663, filed on Sep. 20, 2012, provisional application No. 61/703,659, filed on Sep. 20, 2012, provisional application No. 61/703,661, filed on Sep. 20, 2012, provisional application No. 61/754,803, filed on Jan. 21, 2013, provisional application No. 61/773,661, filed on Dec. 5, 2012.

(56) References Cited

U.S. PATENT DOCUMENTS

| | | | |
|---|---|---|---|
| 2,361,370 | A | 10/1944 | Grunwald |
| 2,394,969 | A | 2/1946 | Robinson |
| 2,661,051 | A | 12/1953 | McCormick |
| 2,673,600 | A | 3/1954 | Cramer |
| 2,786,513 | A | 3/1957 | Hoven et al. |
| 2,946,374 | A | 7/1960 | Dickey |
| 3,174,797 | A | 3/1965 | Neufeld |
| 3,215,468 | A | 11/1965 | Swenson et al. |
| 3,223,450 | A | 12/1965 | Pollock |
| 3,669,499 | A | 6/1972 | Semplonius et al. |
| 3,695,707 | A | 10/1972 | Barecki et al. |
| 3,722,950 | A | 3/1973 | Harnick |
| 3,797,887 | A | 3/1974 | Barecki et al. |
| 3,874,731 | A | 4/1975 | Jordan |
| 4,106,739 | A | 8/1978 | Gasser |
| 4,157,203 | A | 6/1979 | Ambasz |
| 4,333,683 | A | 6/1982 | Ambasz |
| 4,385,783 | A | 5/1983 | Stephens |
| 4,420,186 | A | 12/1983 | Vogt |
| 4,580,836 | A | 4/1986 | Verney |
| 4,597,605 | A | 7/1986 | Gilbert |
| 4,711,491 | A | 12/1987 | Ginat |
| 4,744,600 | A | 5/1988 | Inoue |
| 4,772,070 | A | 9/1988 | Leto, Jr. et al. |
| 4,773,707 | A | 9/1988 | Vadala |
| 4,795,215 | A | 1/1989 | Shimada |
| 4,836,609 | A | 6/1989 | Hill |
| 4,856,846 | A | 8/1989 | Lohmeyer |
| 4,869,552 | A | 9/1989 | Saul et al. |
| 4,875,734 | A | 10/1989 | Yokoyama |
| 4,900,085 | A | 2/1990 | Tobler |
| 5,015,034 | A | 5/1991 | Kindig et al. |
| 5,102,196 | A | 4/1992 | Kaneda et al. |
| 5,265,292 | A | 11/1993 | Underell |
| 5,297,851 | A | 3/1994 | Van Hekken |
| 5,314,240 | A | 5/1994 | Ishi et al. |
| 5,326,155 | A | 7/1994 | Wild |
| 5,338,092 | A | 8/1994 | Wiltsey et al. |
| 5,527,097 | A | 6/1996 | Martin |
| 5,529,373 | A | 6/1996 | Olson et al. |
| 5,630,643 | A | 5/1997 | Scholten et al. |
| 5,704,688 | A | 1/1998 | Schrewe et al. |
| 5,704,691 | A * | 1/1998 | Olson ..... 297/452.27 X |
| 5,716,096 | A | 2/1998 | Pryde et al. |
| 5,746,477 | A | 5/1998 | Saul |
| 5,836,647 | A | 11/1998 | Turman |
| 5,845,967 | A | 12/1998 | Kane et al. |
| 5,904,397 | A | 5/1999 | Fismen |
| 5,944,382 | A | 8/1999 | Ambasz |
| 6,027,164 | A | 2/2000 | Jakubiec et al. |
| 6,033,027 | A | 3/2000 | Conner et al. |
| 6,116,687 | A | 9/2000 | Vogtherr |
| 6,199,900 | B1 | 3/2001 | Zeigler |
| 6,220,661 | B1 | 4/2001 | Peterson |
| 6,257,665 | B1 | 7/2001 | Nagamitsu et al. |
| 6,394,542 | B2 | 5/2002 | Potisch et al. |
| 6,499,801 | B1 | 12/2002 | Simons, Jr. et al. |
| 6,508,509 | B2 | 1/2003 | Peterson |
| 6,616,228 | B2 | 9/2003 | Heidmann |
| 6,726,278 | B1 | 4/2004 | Albright et al. |
| 6,739,663 | B2 | 5/2004 | Gevaert |
| 6,896,327 | B1 | 5/2005 | Barile, Sr. |
| 7,055,911 | B2 | 6/2006 | Simpson et al. |
| 7,104,607 | B2 | 9/2006 | Yasuda et al. |
| 7,419,212 | B2 | 9/2008 | Haygood et al. |
| 7,419,221 | B2 | 9/2008 | Fisher et al. |
| 7,425,040 | B1 | 9/2008 | Honma |
| 7,427,105 | B2 | 9/2008 | Knoblock et al. |
| 7,490,392 | B2 | 2/2009 | Peterson |
| 7,527,335 | B2 | 5/2009 | Eberlein et al. |
| 7,530,640 | B2 * | 5/2009 | Walters et al. ..... 297/452.27 X |
| 7,798,573 | B2 | 9/2010 | Pennington et al. |
| 7,828,387 | B2 | 11/2010 | Yoshizawa |
| 7,837,260 | B2 | 11/2010 | Hein et al. |
| 7,887,137 | B2 | 2/2011 | Fisher et al. |
| 7,922,248 | B2 | 4/2011 | Aldrich et al. |
| 8,011,732 | B2 | 9/2011 | Lindsay |
| 8,029,066 | B2 | 10/2011 | Su |
| 8,152,235 | B2 | 4/2012 | McElmurry |
| 2009/0284060 | A1 | 11/2009 | Charoenapornwatana |
| 2010/0176633 | A1 | 7/2010 | Brncick et al. |

FOREIGN PATENT DOCUMENTS

| | | |
|---|---|---|
| EP | 0555559 | 8/1993 |
| EP | 1106428 | 6/2001 |
| EP | 2534978 | 12/2012 |
| JP | 2002125800 | 5/2002 |
| JP | 2004135768 | 5/2004 |
| JP | 2005168746 | 6/2005 |
| JP | 2012081056 | 4/2012 |
| JP | 2012135490 | 7/2012 |
| JP | 2012135491 | 7/2012 |
| JP | 2012135492 | 7/2012 |
| NZ | 0515700 | 3/2003 |
| WO | 9920155 | 4/1999 |
| WO | 0224032 | 3/2002 |

* cited by examiner

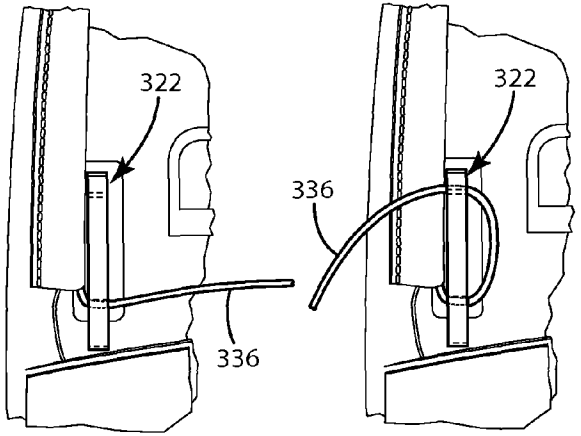
Fig. 21A
Fig. 21B
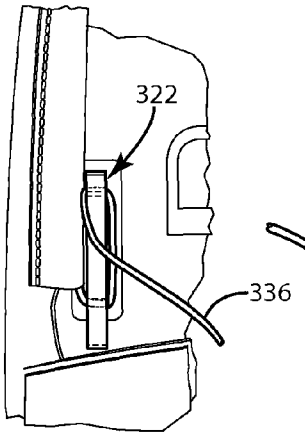
Fig. 21C
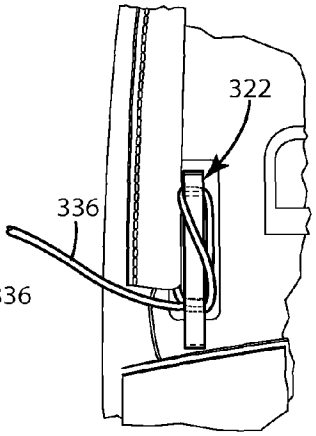
Fig. 21D
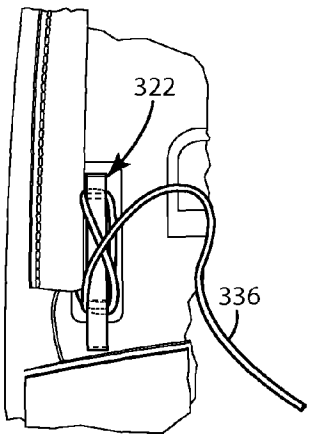
Fig. 21E
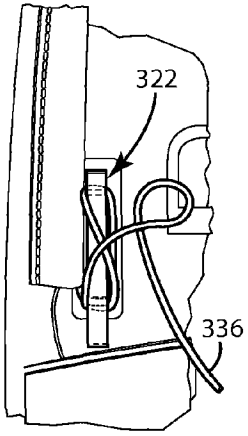
Fig. 21F
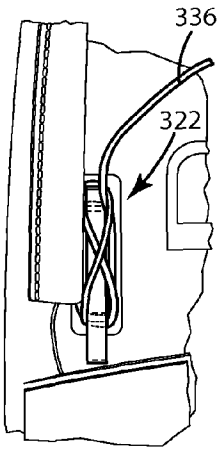
Fig. 21G
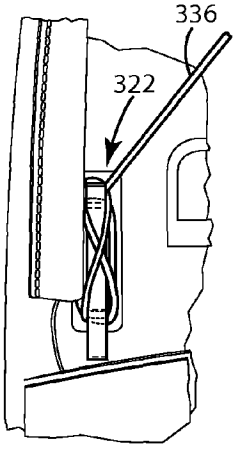
Fig. 21H

CHAIR ASSEMBLY

CROSS REFERENCE TO RELATED APPLICATIONS

This application claims priority to U.S. Provisional Patent Application No. 61/703,677, filed on Sep. 20, 2012, entitled "CHAIR ASSEMBLY," U.S. Provisional Patent Application No. 61/703,667, filed on Sep. 20, 2012, entitled "CHAIR ARM ASSEMBLY," U.S. Provisional Patent Application No. 61/703,666, filed on Sep. 20, 2012, entitled "CHAIR ASSEMBLY WITH UPHOLSTERY COVERING," U.S. Provisional Patent Application No. 61/703,515, filed on Sep. 20, 2012, entitled "SPRING ASSEMBLY AND METHOD," U.S. Provisional Patent Application No. 61/703,663, filed on Sep. 20, 2012, entitled "CHAIR BACK MECHANISM AND CONTROL ASSEMBLY," U.S. Provisional Patent Application No. 61/703,659, filed on Sep. 20, 2012, entitled "CONTROL ASSEMBLY FOR CHAIR," U.S. Provisional Patent Application No. 61/703,661 filed on Sep. 20, 2012, entitled "CHAIR ASSEMBLY," U.S. Provisional Patent Application No. 61/754,803 filed on Jan. 21, 2013, entitled "CHAIR ASSEMBLY WITH UPHOLSTERY COVERING," U.S. Provisional Patent Application No. 61/733,661 filed on Dec. 5, 2012 entitled "CHAIR BACK ASSEMBLY," and U.S. Design patent application Ser. No. 29/457,263 filed on Jun. 7, 2013, entitled "CHAIR," the entire disclosures of which are incorporated herein by reference.

BACKGROUND OF THE INVENTION

The present invention relates to a chair assembly, and in particular to an office chair assembly comprising a back assembly including an upholstery arrangement that wraps about a front surface and a rear surface of the back assembly.

BRIEF SUMMARY OF THE INVENTION

One aspect of the present invention is to provide a chair component that comprises a first chair member adapted to support a seated user, a second chair member movable between a first position, wherein the second chair component is substantially coplanar with the first chair member, and a position, wherein the second chair member is substantially parallel with the first chair member, a cover member wrapped about at least a portion of the first chair member and at least a portion of the second chair member, and a single-piece drawstring operably coupled with the cover member to draw the cover member about the at least a portion of the first chair member and the at least a portion of the second chair member when the second chair member is in the first position.

Another aspect of the present invention is to provide the chair component comprising a first chair member adapted to support a seated user, a second chair component movable between the first position, wherein the second chair member is substantially coplanar with the first chair member and the second chair member is spaced from the first chair member, and a second position, wherein the second chair member contacts the first chair member, a cover member wrapped about at least a portion of the first chair member and at least a portion of the second chair member, and a single-piece drawstring operably coupled with the cover member to draw the cover member about the at least a portion of the first chair member and the at least a portion of the second chair member when the chair member is in the first position.

Yet another aspect of the present invention is to provide a method of assembling a chair component that comprises providing a first chair member adapted to support a seated user, providing a second chair member movable between a first position, wherein the second chair member is substantially coplanar with the first chair member, and a second position, wherein the second chair member is substantially parallel with the first chair member, and wrapping a cover member about at least a portion of the first chair member and at least a portion of the second chair member. The method further comprises providing a drawstring operably coupled with the cover member, drawing the cover member about the at least a portion of the first chair member and the at least a portion of the second chair member when the second chair member is in the first position, fixing an effective length of the drawstring while the second chair member is in the first position, moving the second chair member from the first position to the second position, and securing the second chair member in the second position.

Another aspect of the present invention is to provide a chair component that comprises a first chair member adapted to support a seated user and that includes a forwardly-facing front surface and a rearwardly-facing rear surface that define a first thickness therebetween, the first chair member further includes at least one raised portion extending rearwardly from the rear surface, wherein the front surface and the at least one raised portion define a second thickness therebetween that is greater than the first thickness, and wherein a majority of the first chair member comprises the first thickness, a cover member wrapped about at least a portion of the first chair member, and a drawstring operably coupled with the cover member to draw the cover member about the at least a portion of the first chair member, wherein the drawstring is secured to the first portion by at least one fastener that is received within the raised portion.

Yet another aspect of the present invention is to provide a chair component that comprises a first chair member adapted to support a seated user and that includes a forwardly-facing front surface and a rearwardly-facing rear surface, the first chair member further including at least one raised portion extending rearwardly from the rear surface, a cover member wrapped about at least a portion of the first portion chair member, and a drawstring operably coupled with the cover member to draw the cover member about at least a portion of the first chair member, wherein the cover is aligned with the at least one raised portion, and wherein the drawstring is secured to the first chair member.

Another aspect of the present invention is to provide a method of assembling a chair component that comprises providing a first chair member adapted to support a seated user and the includes a forwardly-facing front surface and a rearwardly-facing rear surface, wherein the first chair member further includes at least one raised portion extending rearwardly from the rear surface, wrapping a cover member about at least a portion of the first chair member, providing a drawstring operably coupled with the cover member, and drawing the cover member about at least a portion of the first chair member by the drawstring. The method further comprises aligning the cover with at least one raised portion to properly align the cover with respect to the first chair member, and securing the drawstring to the first chair member with at least one fastener that is received within the at least one raised portion.

Yet another aspect of the present invention is to provide a chair back assembly that comprises a back frame assembly, a back support assembly operably coupled to the back frame assembly and adapted to support a seated user, wherein the back support assembly is movable between a first position with respect to the back frame assembly and a second position with respect to the back frame assembly that is different than the first position, the back frame assembly and the back support assembly cooperating to define a gap therebetween, the gap defining a first distance when the back support assembly is in the first position and a second distance that is greater than the first distance when the back support assembly is in the second position, and a shield member substantially filling the gap to reduce access thereto as the back assembly is moved between the first and second positions.

These and other features and advantages of the present invention will be further understood and appreciated by those skilled in the art by reference to the following specification, claims, and appended drawings.

BRIEF DESCRIPTION OF THE DRAWINGS

FIGS. 21A-21H illustrate steps of securing a drawstring to the comfort member;

DETAILED DESCRIPTION OF THE PREFERRED EMBODIMENTS

Figure 1:
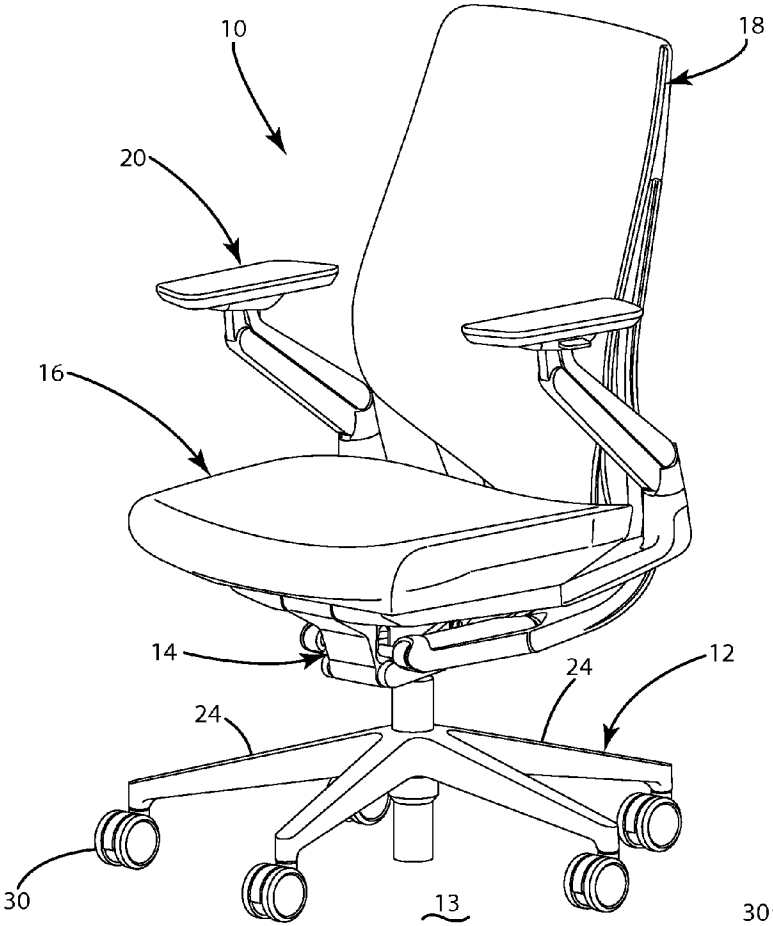
FIG. 1 is a front perspective view of a chair assembly embodying the present invention.
Figure 2:
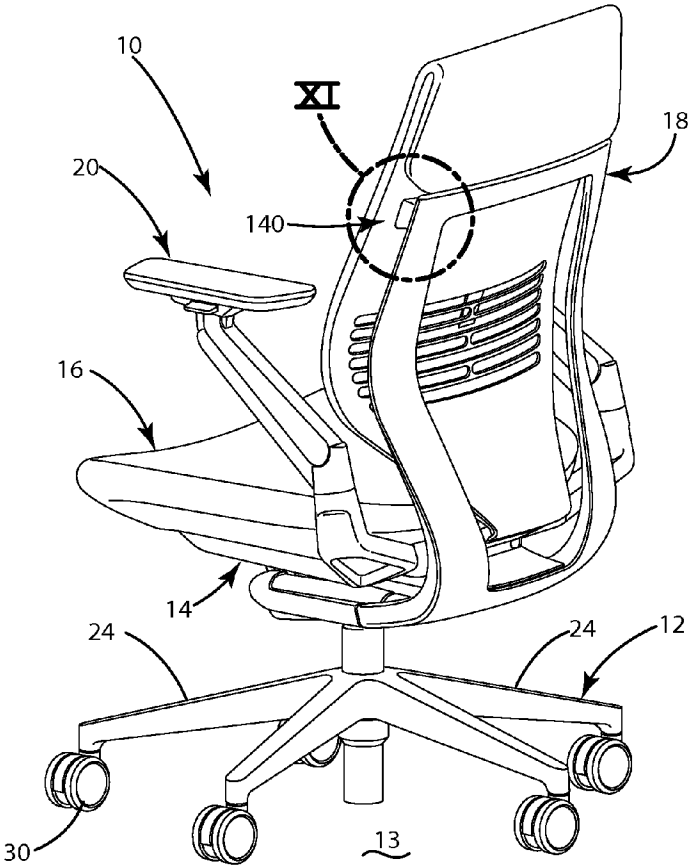
FIG. 2 is a rear perspective view of the chair assembly.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise. Various elements of the embodiments disclosed herein may be described as being operably coupled to one another, which includes elements either directly or indirectly coupled to one another. Further, the term "chair" as utilized herein encompasses various seating arrangements, including office chairs, vehicle seating, home seating, stadium seating, theater seating, and the like.

Figure 4:
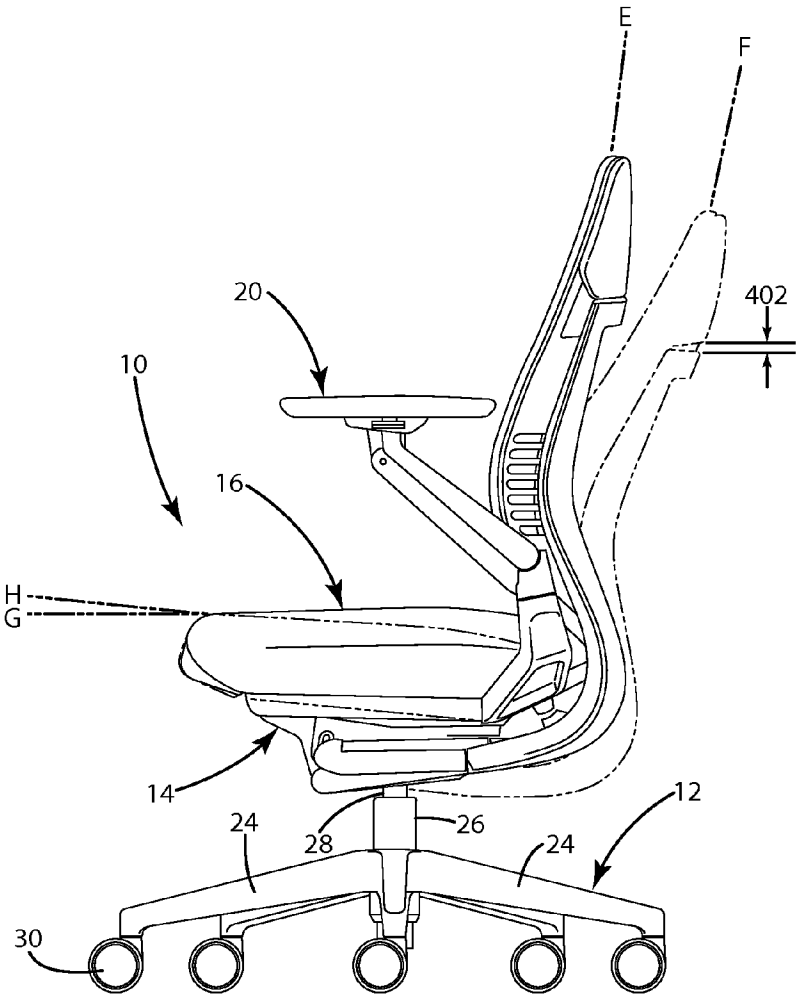
FIG. 4 is a side elevational view of the chair assembly showing the chair assembly in an upright position and in a reclined position in dashed line.
Figure 3:
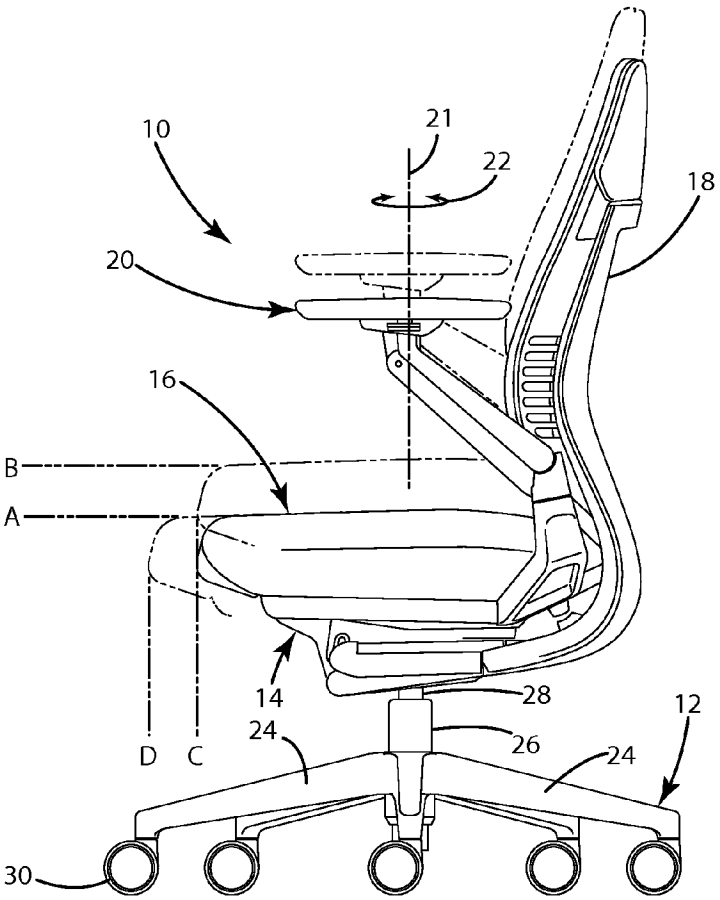
FIG. 3 is a side elevational view of the chair assembly showing the chair assembly in a lowered position and in a raised position in dashed line, and a seat assembly in a retracted position and an extended position in dashed line.

The reference numeral 10 (FIGS. 1 and 2) generally designates a chair assembly embodying the present invention. In the illustrated example, the chair assembly 10 includes a castered base assembly 12 abutting a supporting floor surface 13, a control or support assembly 14 supported by the castered base assembly 12, a seat assembly 16 and back assembly 18 each operably coupled with the control assembly 14, and a pair of arm assemblies 20. The control assembly 14 (FIG. 3) is operably coupled to the base assembly 12 such that the seat assembly 16, the back assembly 18 and the arm assemblies 20 may be vertically adjusted between a fully lowered position A and a fully raised position B, and pivoted about a vertical axis 21 in a direction 22. The seat assembly 16 is operably coupled to the control assembly 14 such that the seat assembly 16 is longitudinally adjustable with respect to the control assembly 14 between a fully retracted position C and a fully extended position D. The seat assembly 16 (FIG. 4) and the back assembly 18 are operably coupled with the control assembly 14 and with one another such that the back assembly 18 is movable between a fully upright position E and a fully reclined position F, and further such that the seat assembly 16 is movable between a fully upright position G and a fully reclined position H corresponding to the fully upright position E and the fully reclined position F of the back assembly 18, respectively.

The base assembly 12 includes a plurality of pedestal arms 24 radially extending and spaced about a hollow central column 26 that receives a pneumatic cylinder 28 therein. Each pedestal arm 24 is supported above the floor surface 13 by an associated caster assembly 30. Although the base assembly 12 is illustrated as including a multiple-arm pedestal assembly, it is noted that other suitable supporting structures maybe utilized, including but not limited to fixed columns, multiple leg arrangements, vehicle seat support assemblies, and the like.

Figure 5:
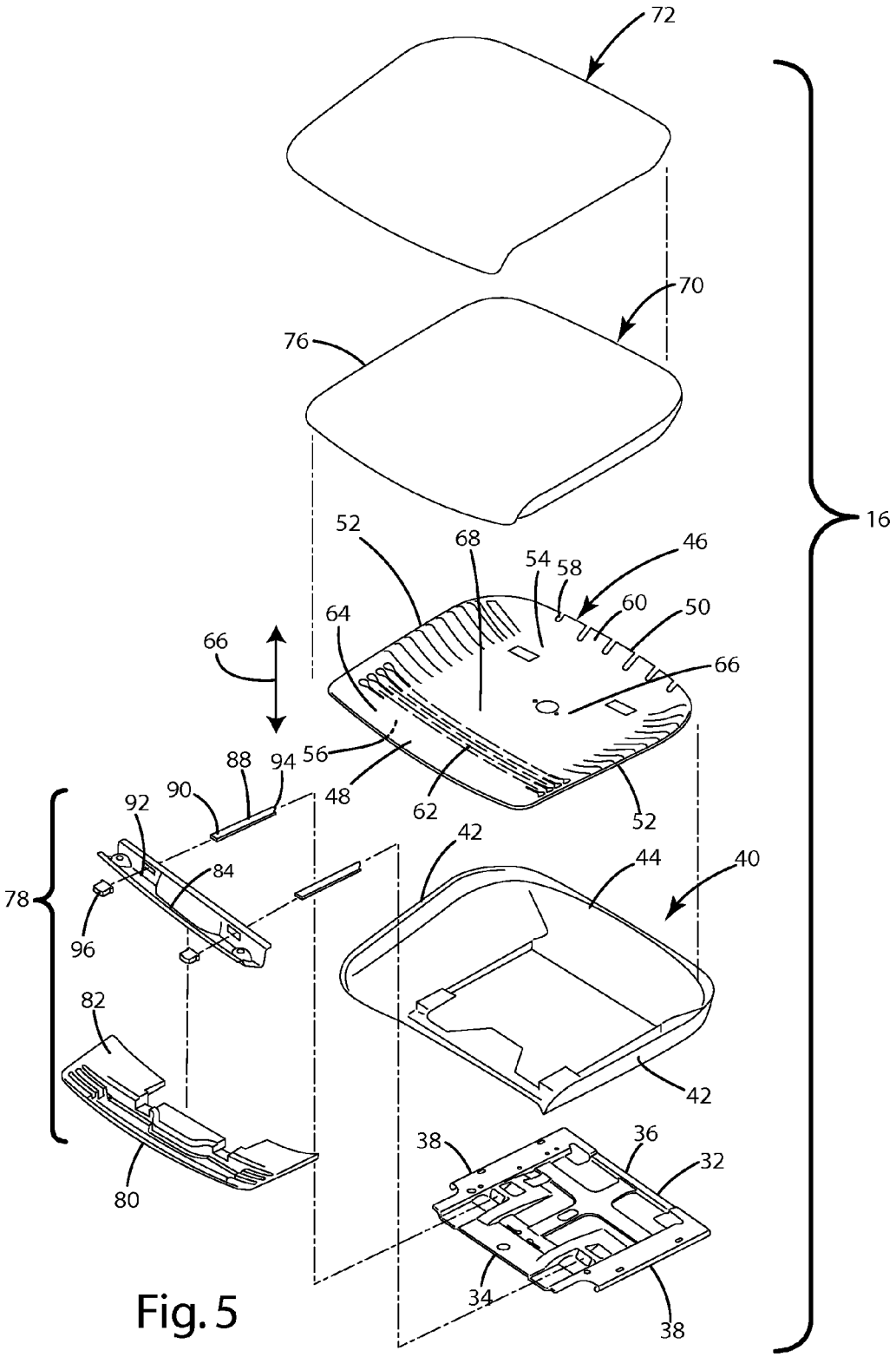
FIG. 5 is an exploded view of the seat assembly.
Figure 6:
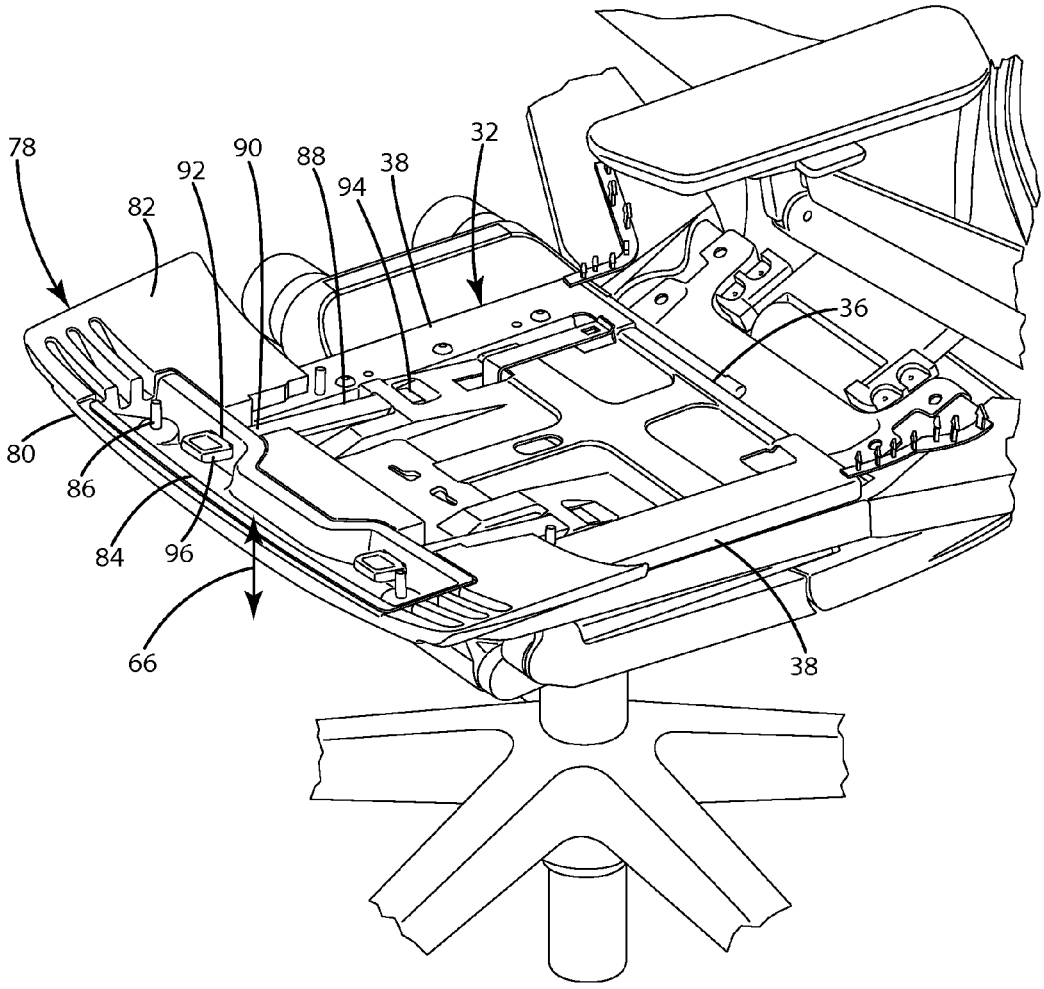
FIG. 6 is an enlarged perspective view of the chair assembly with a portion of the seat assembly removed to illustrate a spring support assembly.

The seat assembly 16 (FIG. 5) includes a relatively rigid seat support plate 32 having a forward edge 34, a rearward edge 36, and a pair of C-shaped guide rails 38 defining the side edges of the seat support plate 32 and extending between the forward edge 34 and the rearward edge 36. The seat assembly 16 further includes a flexibly resilient outer seat shell 40 having a pair of upwardly turned side portions 42 and an upwardly turned rear portion 44 that cooperate to form an upwardly disposed generally concave shape. In the illustrated example, the seat shell 40 is comprised of a relatively flexible material such as a thermoplastic elastomer (TPE). In assembly, the outer seat shell 40 is secured and sandwiched between the seat support plate 32 and a plastic, flexibly resilient seat pan 46 which is secured to the seat support plate 32 by a plurality of mechanical fasteners. The seat pan 46 includes a forward edge 48, a rearward edge 50, side edges 52 extending between the forward edge 48 and the rearward edge 50, a top surface 54 and a bottom surface 56 that cooperate to form an upwardly disposed generally concave shape. In the illustrated example, the seat pan 46 includes a plurality of longitudinally extending slots 58 extending forwardly from the rearward edge 50. The slots 58 cooperate to define a plurality of fingers 60 therebetween, each finger 60 being individually flexibly resilient. The seat pan 46 further includes a plurality of laterally oriented, elongated apertures 62 located proximate the forward edge 48. The apertures 62 cooperate to increase the overall flexibility of the seat pan 46 in the area thereof, and specifically allow a forward portion 64 of the seat pan 46 to flex in a vertical direction 66 with respect to a rearward portion 68 of the seat pan 46, as discussed further below. The seat assembly 16 further includes a foam cushion member 70 that rests upon the top surface 54 of the seat pan 46 and is cradled within the outer seat shell 40, a fabric seat cover 72, and an upper surface 76 of the cushion members 70. A spring support assembly 78 (FIGS. 5 and 6) is secured to the seat assembly 16 and is adapted to flexibly support the forward portion 64 of the seat pan 46 for flexure in the vertical direction 66. In the illustrated example, the spring support assembly 78 includes a support housing 80 comprising a foam and having side portions 82 defining an upwardly concave arcuate shape. The spring support assembly 78 further includes a relatively rigid attachment member 84 that extends laterally between the side portions 82 of the support housing 80 and is located between the support housing 80 and the forward portion 64 of the seat pan 46. A plurality of mechanical fasteners 86 secure the support housing 80 and the attachment member 84 to the forward portion 64 of the seat pan 46. The spring support assembly 78 further includes a pair of cantilever springs 88 each having a distal end 90 received through a corresponding aperture 92 of the attachment member 84, and a proximate end 94 secured to the seat support plate 32 such that the distal end 90 of each cantilever spring 88 may flex in the vertical direction 66. A pair of linear bearings 96 are fixedly attached to the attachment member 84 and aligned with the apertures 92 thereof, such that the linear bearing 96 slideably receives the distal ends 90 of a corresponding cantilever springs 88. In operation, the cantilever springs 88 cooperate to allow the forward portion 64 of the seat pan 46, and more generally the entire forward portion of seat assembly 16 to flex in the vertical direction 66 when a seated user rotates forward on the seat assembly 16 and exerts a downward force on the forward edge thereof.

The back assembly 18 (FIGS. 7-9B) includes a back frame assembly 98 and a back support assembly 99 supported thereby. The back frame assembly 98 is generally comprised of a substantially rigid material such as metal, and includes a laterally extending top frame portion 100, a laterally extending bottom frame portion 102, and a pair of curved side frame portions 104 extending between the top frame portion 100 and the bottom frame portion 102 and cooperating therewith to define an opening 106 having a relatively large upper dimension 108 and a relatively narrow lower dimension 110.

The back assembly 18 further includes a flexibly resilient, plastic back shell 112 that includes a forwardly-located first portion 119 having an upper portion 114 with an upper edge 121, a lower portion 116, a pair of side edges 118 extending between the upper portion 114 and a lower portion 116, a forwardly facing surface 120 and a rearwardly facing surface 122, wherein the width of the upper portion 114 is generally greater than the width of the lower portion 116, and the lower portion 116 is downwardly tapered to generally follow the rear elevational configuration of the frame assembly 98. The back shell 112 further includes a rearwardly-located second portion 123 having an upper edge 125, a lower edge 127 and a pair of side edges 129 extending between the upper edge 125 and the lower edge 127. The second portion 123 is generally aligned with the upper portion 114 of the first portion 119 such that the upper edge 125 and the side edges 129 of the second portion 123 are generally aligned with the upper edge 121 and the side edges 118 of the first portion 119, respectively, as described below.

A lower reinforcement member 115 attaches to hooks 117 (FIG. 9A) of lower portion 116 of the first portion 119 of the back shell 112. Reinforcement member 115 includes a plurality of protrusions 113 that engage reinforcement ribs 134 to prevent side-to-side movement of lower reinforcement member 115 relative to the back shell 112.

Figure 10:
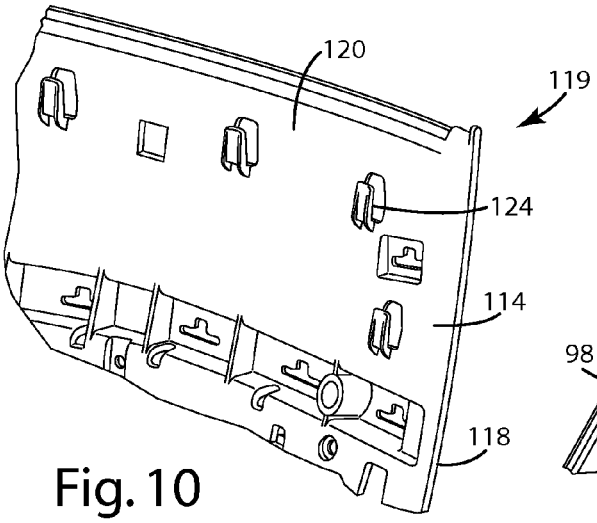
FIG. 10 is an enlarged perspective view of an area X, FIG. 9A.

The first portion 119 of the back shell 112 also includes a plurality of integrally molded, forwardly and upwardly extending hooks 124 (FIG. 10) spaced about the periphery of the upper portion 114 thereof. An intermediate or lumbar portion 126 is located vertically between the upper portion 114 and the lower portion 116 of the first portion 119 of the back shell 112, and includes a plurality of laterally extending slots 128 that cooperate to form a plurality of laterally extending ribs 130 located therebetween. The slots 128 cooperate to provide additional flexure to the back shell 112 in the location thereof. Pairings of lateral ribs 130 are coupled by vertically extending ribs 132 integrally formed therewith and located at an approximate lateral midpoint thereof. The vertical ribs 132 function to tie the lateral ribs 130 together and reduce vertical spreading therebetween as the back shell 112 is flexed at the intermediate portion 126 thereof when the back assembly 18 is moved from the upright position E to the reclined position F, as described further below. The first portion 119 of the back shell 112 further includes a plurality of laterally-spaced reinforcement ribs 134 extending longitudinally along the vertical length of the first portion 119 between the lower portion 116 and the intermediate portion 126. It is noted that the depth of each of the ribs 134 increases the further along each of the ribs 134 from the intermediate portion 126, such that the overall rigidity of the back shell 112 increases along the length of the ribs from the intermediate portion 126 toward the lower portion 116.

The first portion 119 of the back shell 112 further includes a pair of rearwardly extending, integrally molded pivot bosses 138 forming part an upper back pivot assembly 140. The back pivot assembly 140 (FIGS. 11 and 12) includes the pivot bosses 138 of the back shell 112, a pair of shroud members 142 that encompass respective pivot bosses 138, a race member 144, and a mechanical fastening assembly 146. Each pivot boss 138 includes a pair of side walls 148 and a rearwardly-facing concave seating surface 150 having a vertically elongated pivot slot 152 extending therethrough. Each shroud member 142 is shaped so as to closely house the corresponding pivot boss 138, and includes a plurality of side walls 154 corresponding to side walls 148, and a rearwardly-facing concave bearing surface 156 that includes a vertically elongated pivot slot extending therethrough, and which is adapted to align with the slot 152 of a corresponding pivot boss 138. The race member 144 includes a center portion 158 extending laterally along and abutting the top frame portion 100 of the back frame assembly 98, and a pair of arcuately-shaped bearing surfaces 160 located at the ends thereof. Specifically, the center portion 158 includes a first portion 162, and a second portion 164, wherein the first portion 162 abuts a front surface of the top frame portion 100 and second portion 164 abuts a top surface of the top frame portion 100. Each bearing surface 160 includes an aperture 166 extending therethrough.

Figure 7:
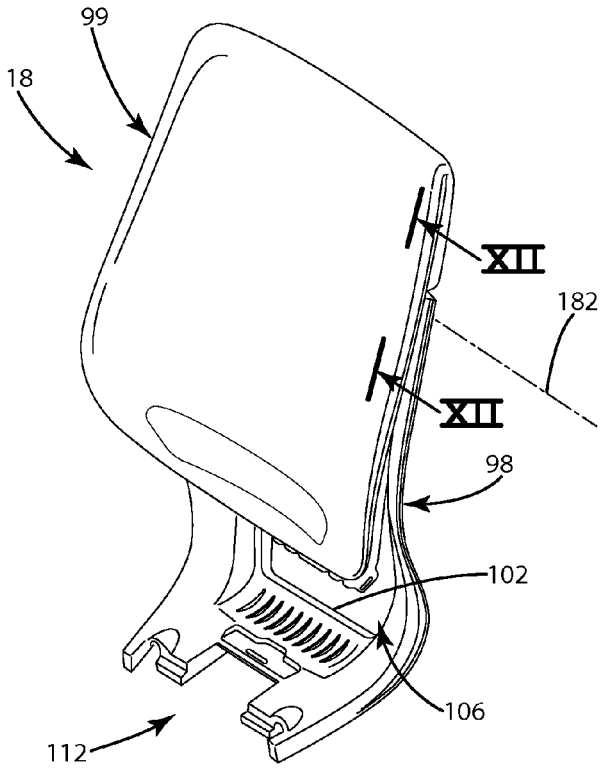
FIG. 7 is a front perspective view of a back assembly.

In assembly, the shroud members 142 are positioned about the corresponding pivot bosses 138 of the back shell 112 and operably positioned between the first portion 119 of the back shell 112 and race member 144 such that the bearing surface 156 is sandwiched between the seating surface 150 of a corresponding pivot boss 138 and a bearing surface 160. The mechanical fastening assemblies 146 each include a bolt 172 that secures a rounded abutment surface 174 of the bearing washer 176 in sliding engagement with an inner surface 178 of the corresponding pivot boss 138, and threadably engages a corresponding boss member 168 of the back frame assembly 98. In operation, the upper back pivot assembly 140 allows the back support assembly 99 to pivot with respect to the back frame assembly in a direction 180 (FIG. 8) about a pivot axis 182 (FIG. 7).

Figure 9A:
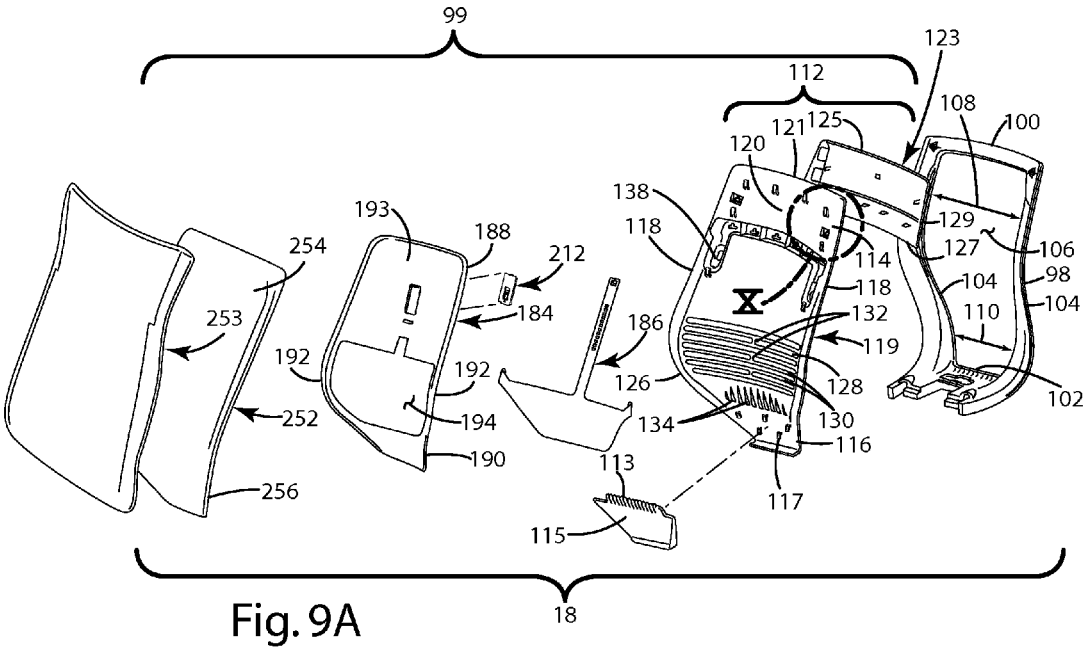
FIG. 9A is an exploded front perspective view of the back assembly.
Figure 9B:
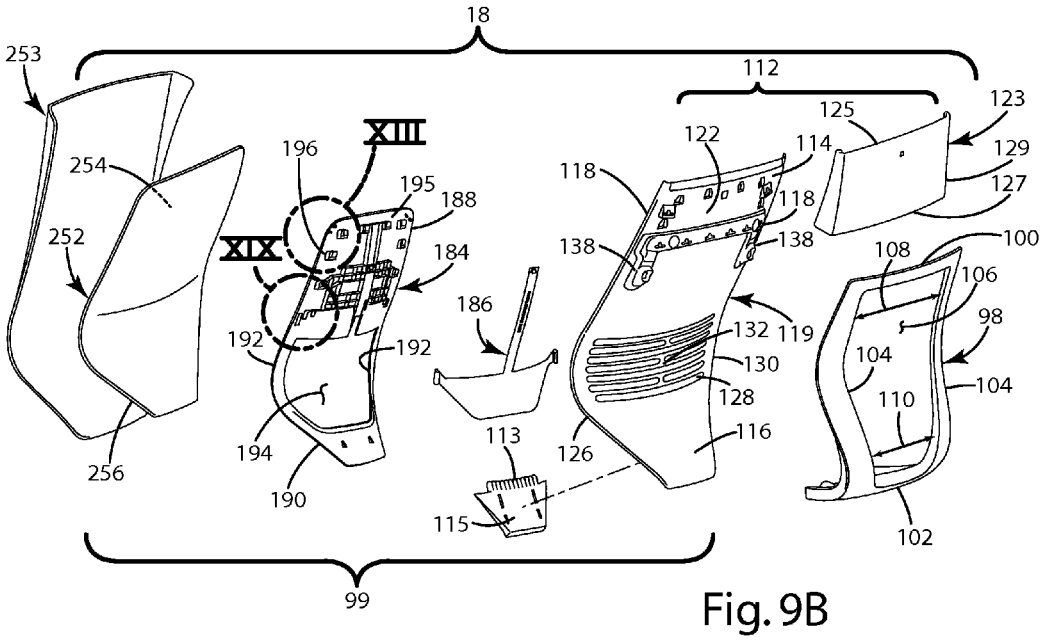
FIG. 9B is an exploded rear perspective view of the back assembly.
Figure 12:
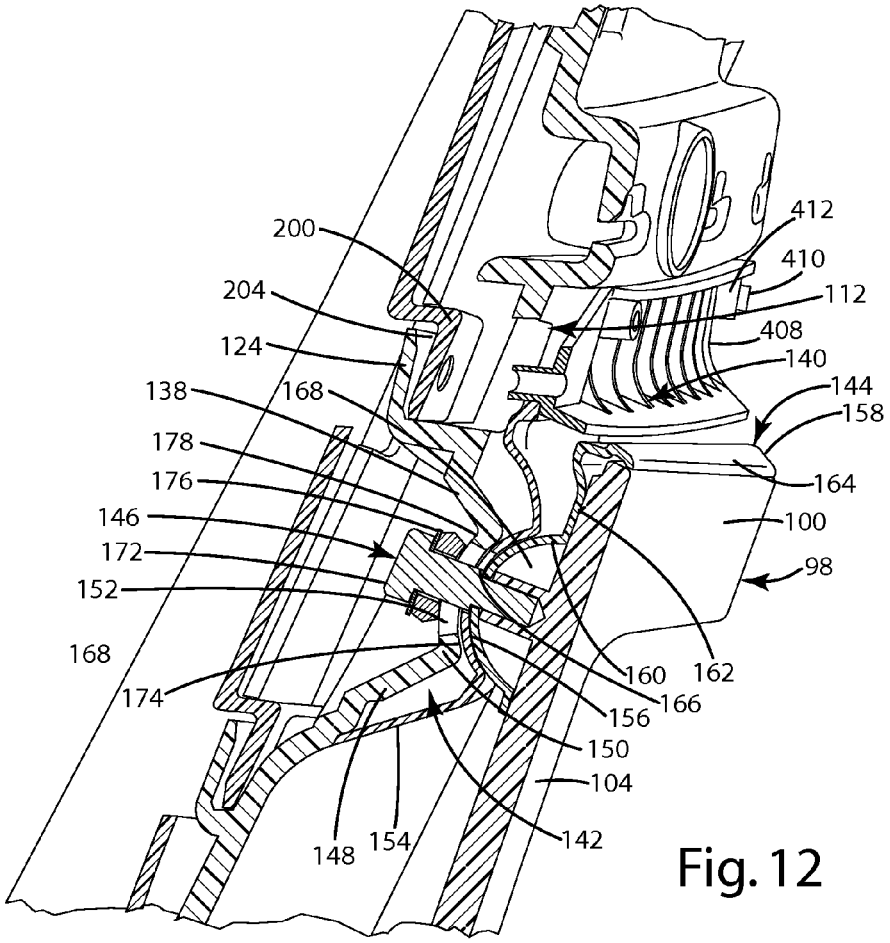
FIG. 12 is a cross-sectional view of an upper back pivot assembly taken along the line XII-XII, FIG. 7.
Figure 13:
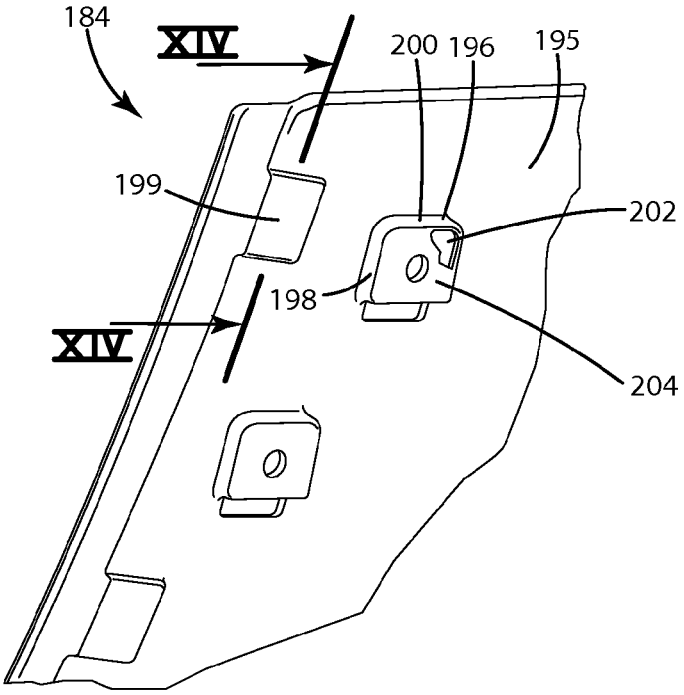
FIG. 13 is an enlarged perspective view of the area XIII, FIG. 9B.
Figure 14:
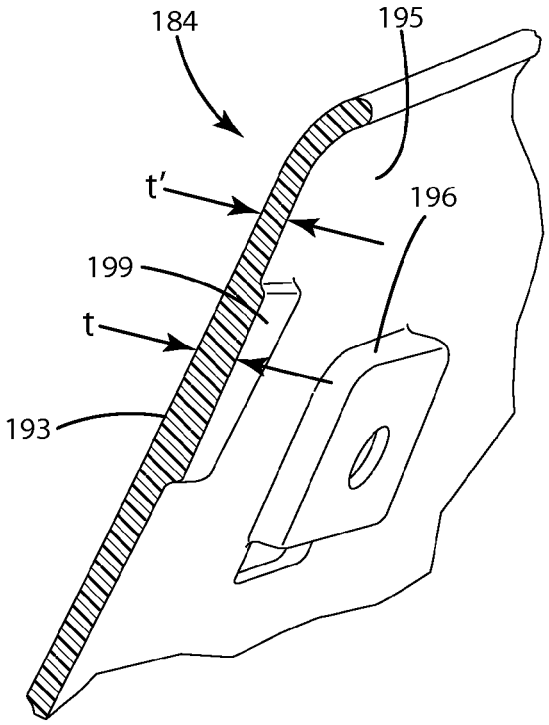
FIG. 14 is a cross-sectional side view of a comfort member taken along the line XIV-XIV, FIG. 13.
Figure 15A:
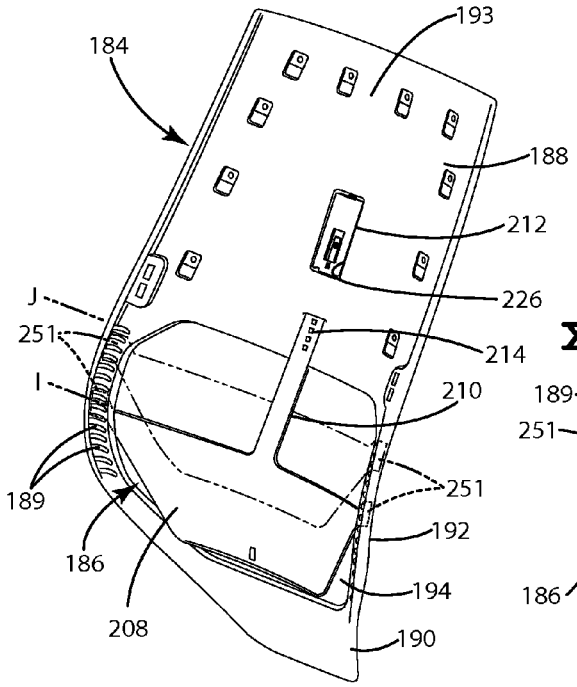
FIG. 15A is an enlarged perspective view of the comfort member and a lumbar assembly.
Figure 15B:
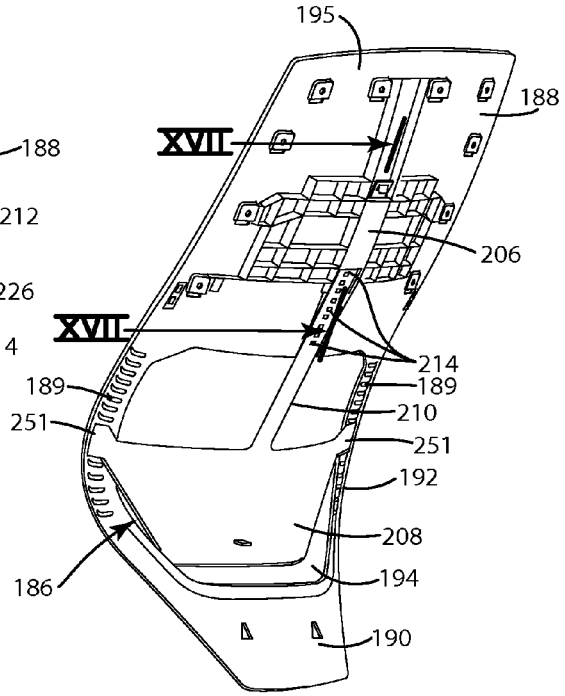
FIG. 15B is a rear perspective view of the comfort member and the lumbar assembly.

The back support assembly 99 (FIGS. 9A and 9B) further includes a flexibly resilient comfort member 184 (FIGS. 15A and 15B) attached to the back shell 112 and slideably supporting a lumbar assembly 186. The comfort member 184 includes an upper portion 188, a lower portion 190, a pair of side portions 192 having a plurality of apertures 189 spaced therealong to increase the flexure thereof, a forward surface 193 and a rearward surface 195, wherein the upper portion 188, the lower portion 190 and the side portions cooperate to form an aperture 194 that receives the lumbar assembly 186 therein. As best illustrated in FIGS. 9B and 13, the comfort member 184 includes a plurality of box-shaped couplers 196 spaced about the periphery of the upper portion 188 and extending rearwardly from the rearward surface 195. Each box-shaped coupler 196 includes a pair of side walls 198, a top wall 200 and a rear wall 204 that cooperate to form an interior space 202. In assembly, the comfort member 184 (FIGS. 12-14) is secured to the back shell 112 by aligning and vertically inserting the hooks 124 of the back shell 112 into the interior space 202 of each of the box-shaped couplers 196. The comfort member 184 further includes a plurality of upholstery alignment and connection pads 199 extending rearwardly from the rearward surface 195 and spaced about the outer periphery of the comfort member 184. As best illustrated in FIG. 14, the thickness t of the comfort member 184 in the region of the pads 199 is greater than the thickness t' of the comfort member 184 in other regions of the comfort member 184. In the illustrated example, the majority of the area of the comfort member 184 comprises the thickness t'. The pads 199 function to increase the structural rigidity of the comfort member 184 in the areas the upholstery arrangement is attached thereto, as well as to provide alignment features for properly aligning the upholstery arrangement with respect to the comfort member 184 during assembly, as described below.

Figure 16A:
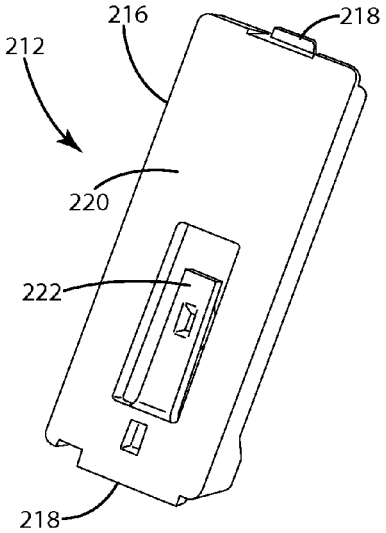
FIG. 16A is a front perspective view of a pawl member.
Figure 16B:
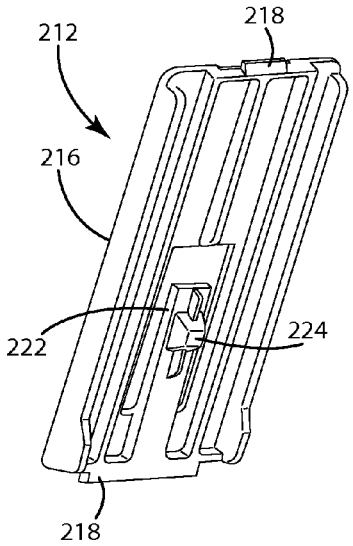
FIG. 16B is a rear perspective view of the pawl member.

The comfort member 184 (FIGS. 15A and 15B) includes an integrally molded, longitudinally extending sleeve 206 extending rearwardly from the rearward surface 195 and having a rectangularly-shaped cross-sectional configuration. The lumbar assembly 186 includes a forwardly laterally concave and forwardly vertically convex, flexibly resilient body portion 208, and an integral support portion 210 extending upwardly from the body portion 208. In the illustrated example, the body portion 208 is shaped such that the body portion 208 vertically tapers along the height thereof so as to generally follow the contours and shape of the aperture 194 of the comfort member 184. The support portion 210 is slideably received within the sleeve 206 of the comfort member 184 such that the lumbar assembly 186 is vertically adjustable with respect to the remainder of the back support assembly 99 between a fully lowered position I and a fully raised position J. A pawl member 212 selectively engages a plurality of apertures 214 spaced along the length of support portion 210, thereby releasably securing the lumbar assembly 186 at selected vertical positions between the fully lowered position I and the fully raised position J. The pawl member 212 (FIGS. 16A and 16B) includes a housing portion 216 having engagement tabs 218 located at the ends thereof and rearwardly offset from an outer surface 220 of the housing portion 216. A flexibly resilient finger 222 is centrally disposed within the housing portion 216 and includes a rearwardly-extending pawl 224.

Figure 17:
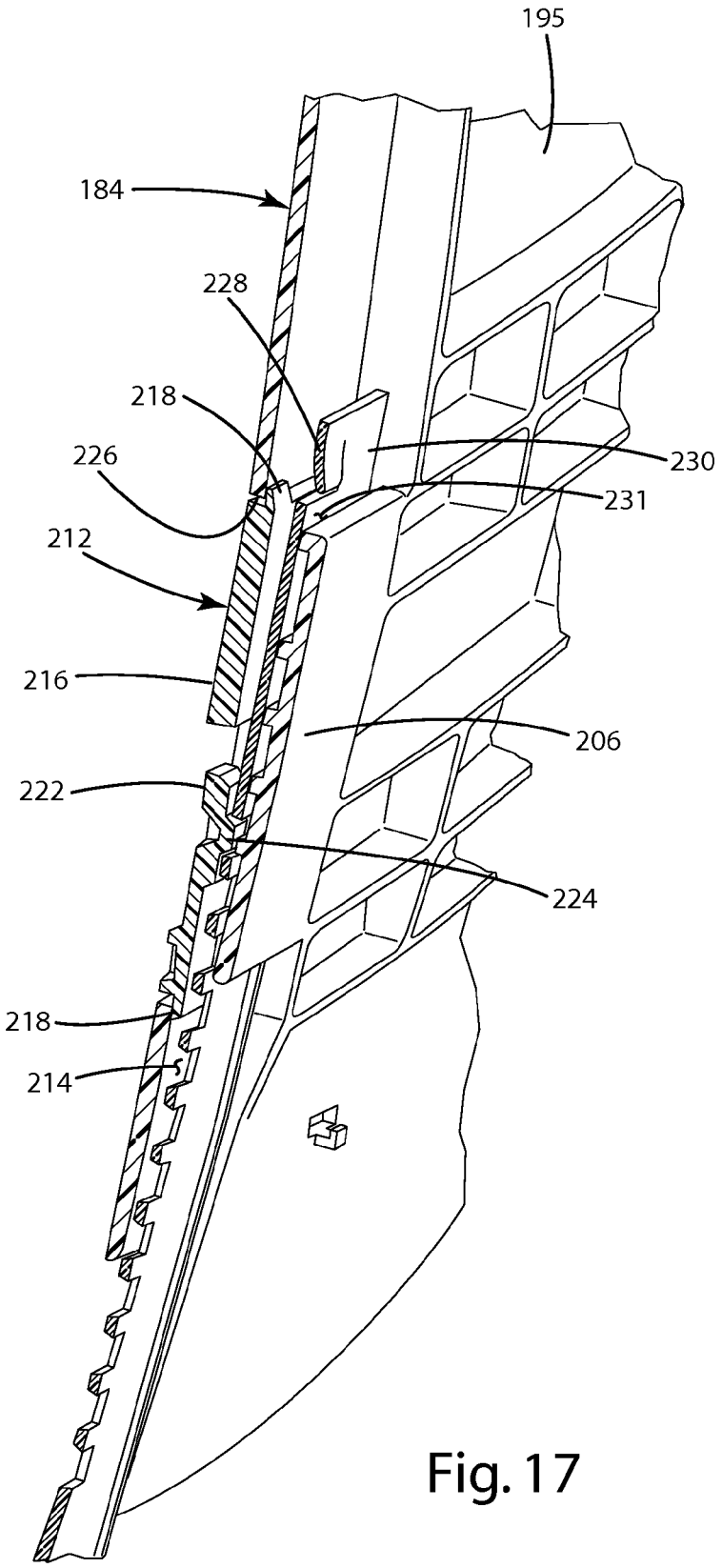
FIG. 17 is a partial cross-sectional perspective view along the line XVIII-XVIII, FIG. 15B.

In assembly, the pawl member 212 (FIG. 17) is positioned within an aperture 226 located within the upper portion 188 of the comfort member 184 such that the outer surface 220 of the housing portion 216 of the pawl member 212 is coplanar with the forward surface 193 of the comfort member 184, and such that the engagement tabs 218 of the housing portion 216 abut the rearward surface 195 of the comfort member 184. The support portion 210 of the lumbar assembly 186 is then positioned within the sleeve 206 of the comfort member 184 such that the sleeve 206 is slideable therein and the pawl 224 is selectively engageable with the apertures 214, thereby allowing the user to optimize the position of the lumbar assembly 186 with respect to the overall back support assembly 99. Specifically, the body portion 208 of the lumbar assembly 186 includes a pair of outwardly extending integral handle portions 251 (FIG. 18*d*) each having a C-shaped cross-sectional configuration that wraps about and guides along the respective side edge 192 of the back shell 112.

In operation, a user adjusts the relative vertical position of the lumbar assembly 186 with respect to the back shell 112 by grasping one or both of the handle portions 251 and sliding the handle assembly 251 along the back shell 184 in a vertical direction. A stop tab 228 is integrally formed within a distal end 230 and is offset therefrom so as to engage an end wall of the sleeve 206 of the comfort member 184, thereby limiting the vertical downward travel of the support portion 210 of the lumbar assembly 186 with respect to the sleeve 206 of the comfort member 184.

The back support assembly 99 (FIGS. 9A and 9B) also includes a cushion member 252 having an upper portion 254 and a lower portion 256, wherein the lower portion 256 tapers along the vertical length thereof to correspond to the overall shape and taper of the back shell 112 and the comfort member 184, and a topper cushion 253 comprising a relatively thin foam material.

Figure 18A:
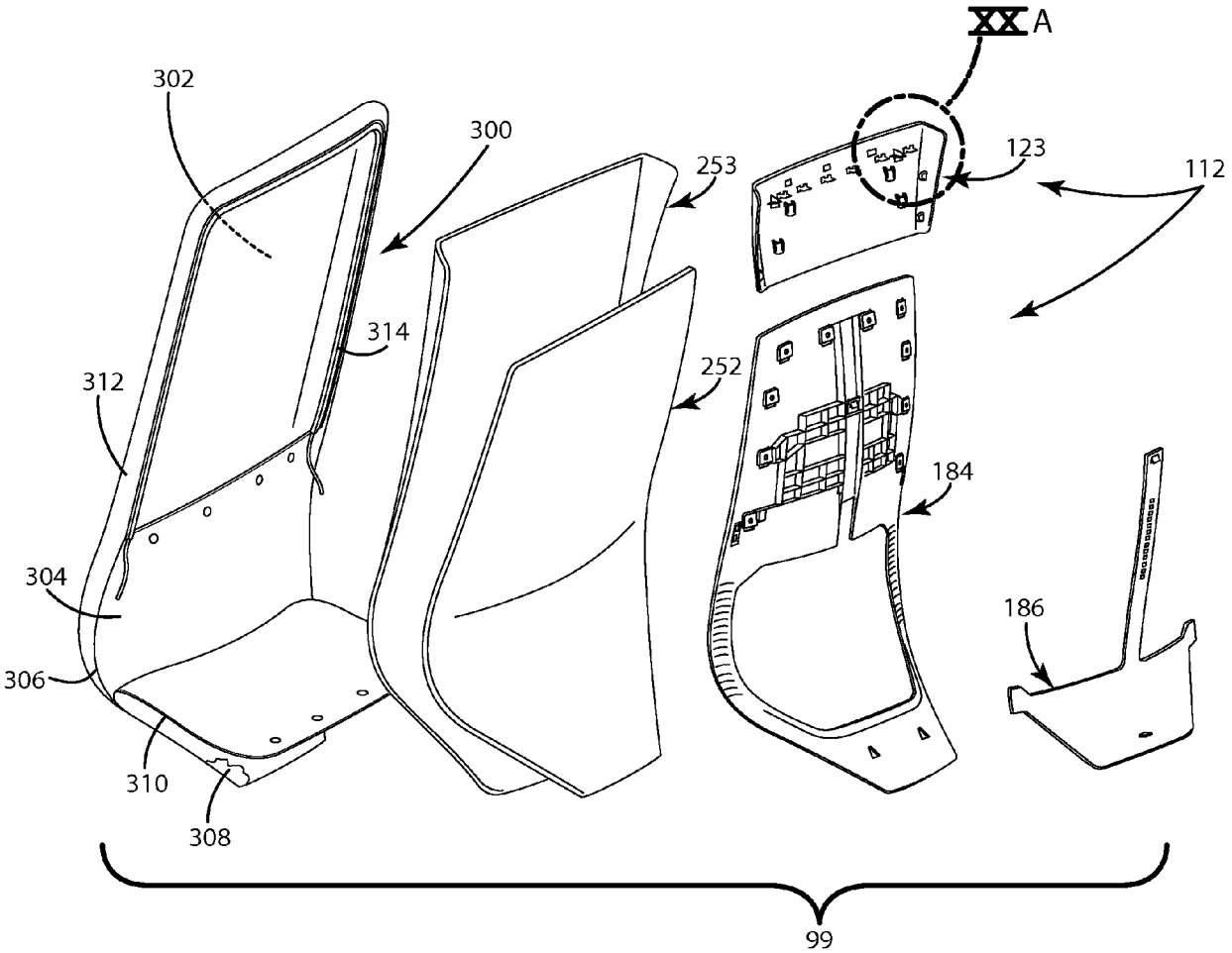
FIGS. 18A-18D are each exploded perspective views illustrating various steps of assembling a back support assembly, with a fixture shown in dotted line in FIG. 18B.

The back support assembly 99 (FIG. 18A) further includes an upholstery arrangement or cover assembly 300 that houses the back shell 112, the lumbar support assembly 186, the cushion member 252 and a topper cushion 253 therein. In the illustrated example, the cover assembly 300 comprises a fabric material that may be elastically deformable in one or more directions. The cover assembly 300 includes a front side 302 and a rear side 304 that are sewn together along the respective side edges thereof to form a first pocket 306 having a first interior or inner space 308 that receives the comfort member 184, the cushion member 252 and the topper cushion 253 therein, and a flap portion 310 that is sewn to the rear side 304 and cooperates therewith to form a second pocket 348 having a second interior or inner space 350 that receives the lumbar support assembly 186 therein. It is noted that the cushion member 252, the comfort member 184 and the second portion 123 of the back shell 112 are assembled with the topper cushion 253 prior to assembly with the cover assembly 300, and specifically are attached to a rear surface of the topper cushion 253 via an adhesive.

Figure 18B:
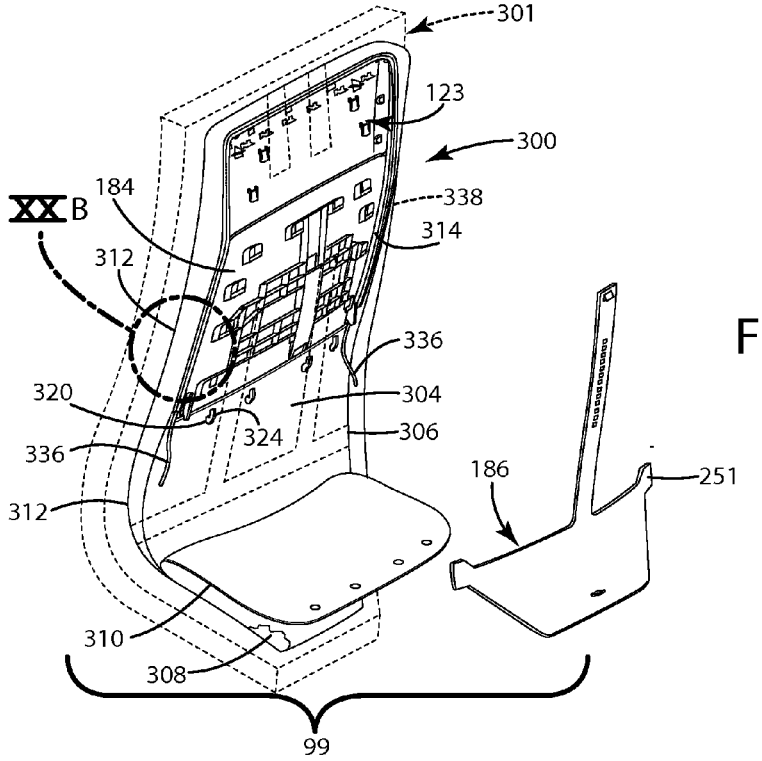
Figure 18C:
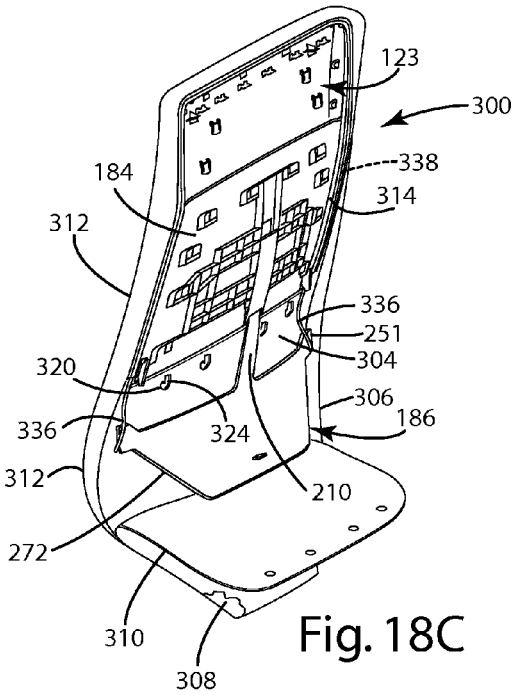
Figure 19:
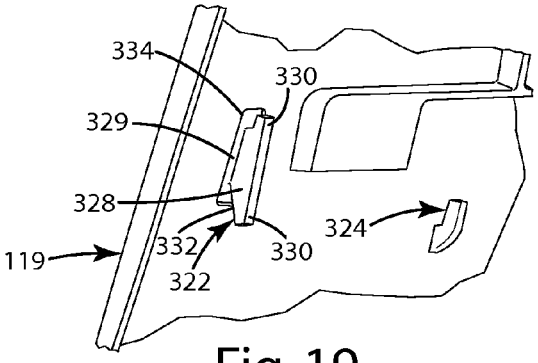
FIG. 19 is a perspective view of the area XIX, FIG. 9B.

In assembly, the first pocket 306 is formed by attaching the respective side edges of the front side 302 and the rear side 304 to one another such as by sewing or other means suitable for the material for which the cover assembly 300 is comprised, and to define the first interior space 308. An edge of the flap portion 310 is then secured to the rear side 304 proximate a midsection 312 thereof. In the illustrated example, the comfort member 184 and the second portion 123 of the back shell 112 are placed within a fixture 301 (FIG. 18B) that holds the second portion 123 in a planar relationship to the comfort member 184. The combination of the second portion 123 of the back shell 164, the comfort member 184 and the cushion member 296 are then inserted into the interior space 308 of the first pocket 306 via an aperture 314 located on the rear side 304 (FIG. 18B). The upholstery cover assembly 300 is stretched about the cushion member 252, the second portion 123 of the back shell 112 and the comfort member 184, and is secured to the comfort member 184 by a plurality of apertures 320 that receive upwardly extending hook members 324 (FIG. 19) therethrough. Alternatively, the cover assembly 300 may be configured such that apertures 320 are positioned to also receive T-shaped attachment members 322 therethrough. In the illustrated example, the attachment members 322 and the hook members 324 are integrally formed with the comfort member 184. Each attachment member 322 is provided with a T-shaped cross-section or boat-cleat configuration having a first portion 328 extending perpendicularly rearward from within a recess 329 of the rear surface 256 of the comfort member 184, and a pair of second portions 330 located at a distal end of the first portion 328 and extending outwardly therefrom in opposite relation to one another. One of the second portions 330 cooperates with the first portion 328 to form an angled engagement surface 332. The recess 329 defines an edge 334 about the perimeter thereof.

The cover assembly 300 is further secured to the comfort member 184 by a single, continuous drawstring 336 that extends through a drawstring tunnel 338 of the cover assembly 300, which is captured within multiple attachment features of the second portion 123 of the back shell 112 and the comfort member 184 and is in turn secured to the attachment members 322. Specifically, the drawstring 336 and drawstring tunnel 338 are aligned with and secured to the plurality of upholstery alignment and connection pads 199' (FIG. 20A) similar to the pads 199 (FIG. 20B) of the comfort member 184 via a plurality of staples (not shown). Alternatively, the drawstring 336 and drawstring tunnel 338 are routed about hook members 313 (FIG. 20C) located near the corners between the bottom edge 127 and side edges 129 of the second portion 123 of the back shell 112, and are captured by a plurality of couplers 315 each including a plurality of elastically resilient, interspaced teeth 317 and spaced about the periphery of the second portion 123. The drawstring 336 and drawstring tunnel 338 are then aligned with the pads 199 of the second portion 123 to assure proper alignment of the cover assembly 300 with the back shell 112 and the overall back support assembly 99. In the illustrated example, the drawstring 336 and drawstring tunnel 338 are secured to the second portion via a plurality of staples 319 which are inserted into the thicker pads 199.

As best illustrated in FIGS. 21A-21H, the drawstring 336 is drawn taut and each free end of the drawstring 336 is then secured to an associated attachment member 322 in a knot-free manner and without the use of a mechanical fastener that is separate from the comfort member 184, thereby fixing the effective length of the drawstring 336 through the remainder of the assembly process. The drawstring 336 is wrapped about the associated attachment member 322 such that the tension in the drawstring 336 about the attachment member 322 forces the drawstring 366 against the engagement surface 332 that angles towards the recess 329, thereby forcing a portion of the drawstring 336 into the recess 329 and into engagement with at least a portion of the edge 334 of the recess 329 resulting in an increased frictional engagement between the drawstring 336 and the comfort member 184. The lumbar assembly 186 is then aligned with the assembly of the cover assembly 300, the cushion member 252 and the comfort member 184 such that the body portion 272 of the lumbar assembly 186 is located near the midsection 312 of the cover assembly 300, and the support portion 210 of the lumbar assembly 186 is coupled with the comfort member 184 as described above. The flap portion 310 is then folded over the lumbar assembly 186, thereby creating the additional pocket 348 (FIG. 18D) having the interior space 350. A distally located edge 352 of the flap portion 310 is attached to the comfort member 184 by a plurality of apertures 354 with the flap portion 310 that receive the hooks 324 therethrough. The distal edge 352 may also be sewn to the rear side 304 of the cover assembly 300. In the illustrated example, the side edges 356 of the flap portion 310 are not attached to the remainder of the cover assembly 300, such that the side edges 356 cooperate with the remainder of the cover assembly 300 to form slots 360 through with the handle portions 251 of the lumbar assembly 186. The second pocket 348 is configured such that the lumbar assembly 186 is vertically adjustable therein.

Figure 8:
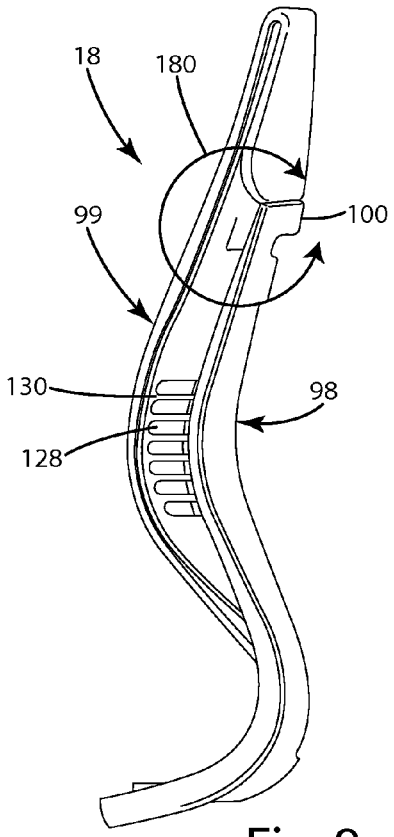
FIG. 8 is a side elevational view of the back assembly.
Figure 11:
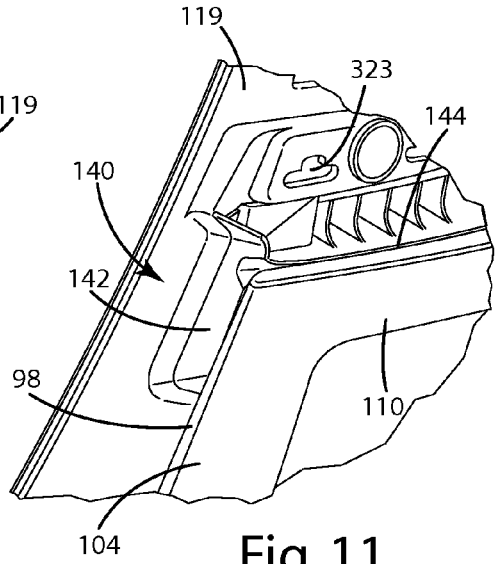
FIG. 11 is an enlarged perspective view of an area XI, FIG. 2.
Figure 18D:
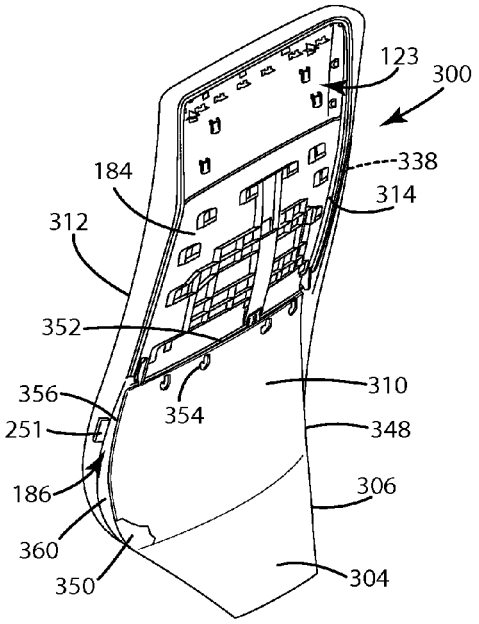
Figure 20A:
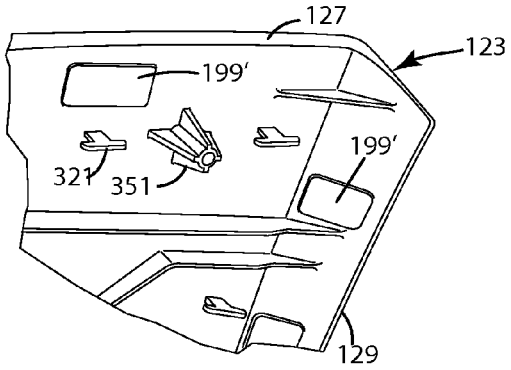
FIG. 20A is a perspective view of the area XXA, FIG. 18A.
Figure 20C:
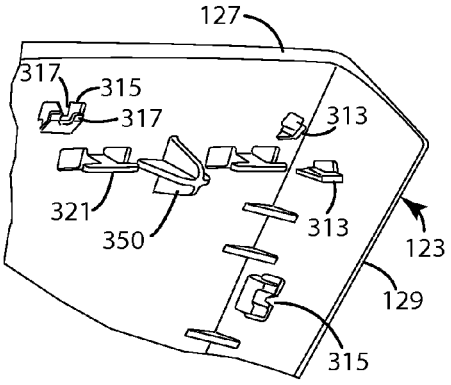
FIG. 20C is an alternative embodiment to the embodiment shown in FIG. 20A.
Figure 20B:
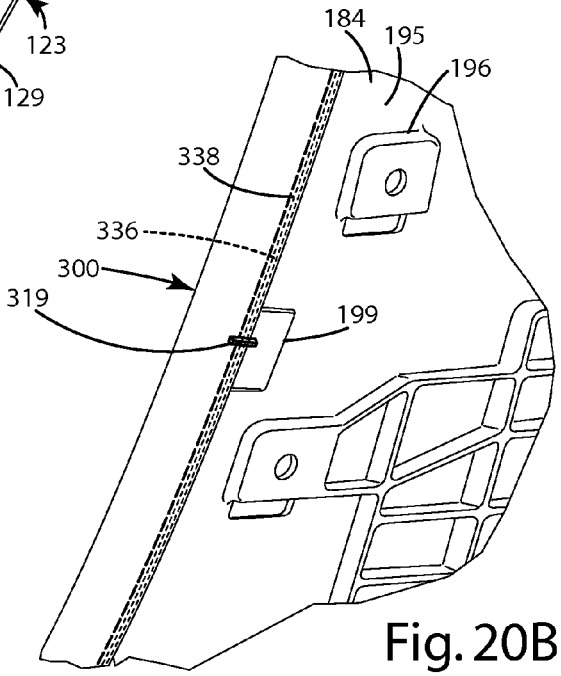
FIG. 20B is a perspective view of the area XXB, FIG. 18B.
Figure 24:
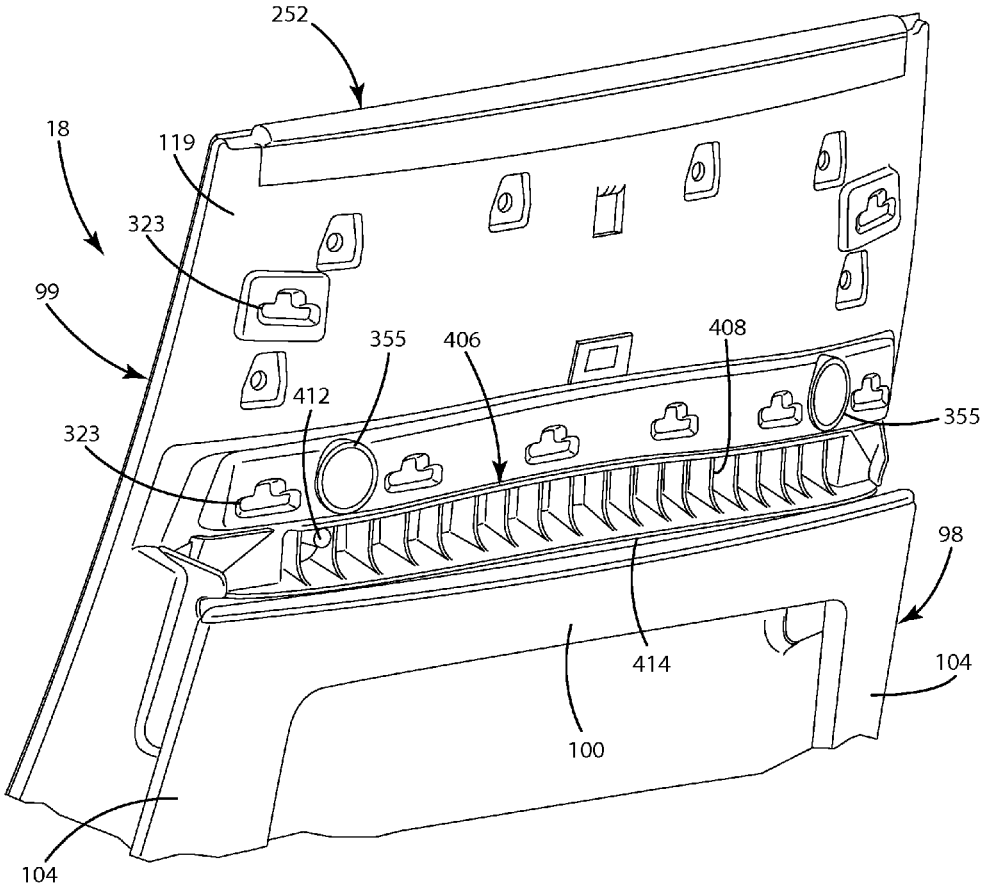
FIG. 24 is a perspective view of the back support assembly with outer components removed to show interior components thereof.

The assembly of the cover assembly 300, the cushion member 252, the comfort member 184, the lumbar assembly 186 and the second portion 123 of the back shell 112 are then attached to the first portion 119 of the back shell 112. Specifically, the comfort member 184 and the second portion 123 of the back shell 112 are removed from the associated fixture (301), and the comfort member 184 is then attached to the first portion of the back shell via the hooks 124 and box-shaped couplers 196 as previously described. The second portion 123 of the back shell 112 is then rotated about the first portion 119 of the back shell 112 from a position where the second portion 123 is generally planar with the first portion 119, as shown in FIG. 18D, to a position where the second portion 123 is wrapped about the first portion 119 and is generally parallel therewith, as shown in FIG. 8. As best illustrated in FIGS. 11 and 20A, the second portion 123 includes a plurality of rearwardly-extending T-shaped couplers 321, while the first portion includes a plurality of cooperating slots 323 that releasably received the couplers 321 therein, thereby securing the second portion 123 in the second position. Proper alignment of the second portion 123 with the first portion 119 is provided via generally conically-shaped locators 351 (FIG. 20A) extending forwardly from the second portion 123 that locate and align with corresponding conically-shaped recesses 355 (FIG. 24) extending into the rear surface of the first portion 119 of the back shell 112.

Figure 22:
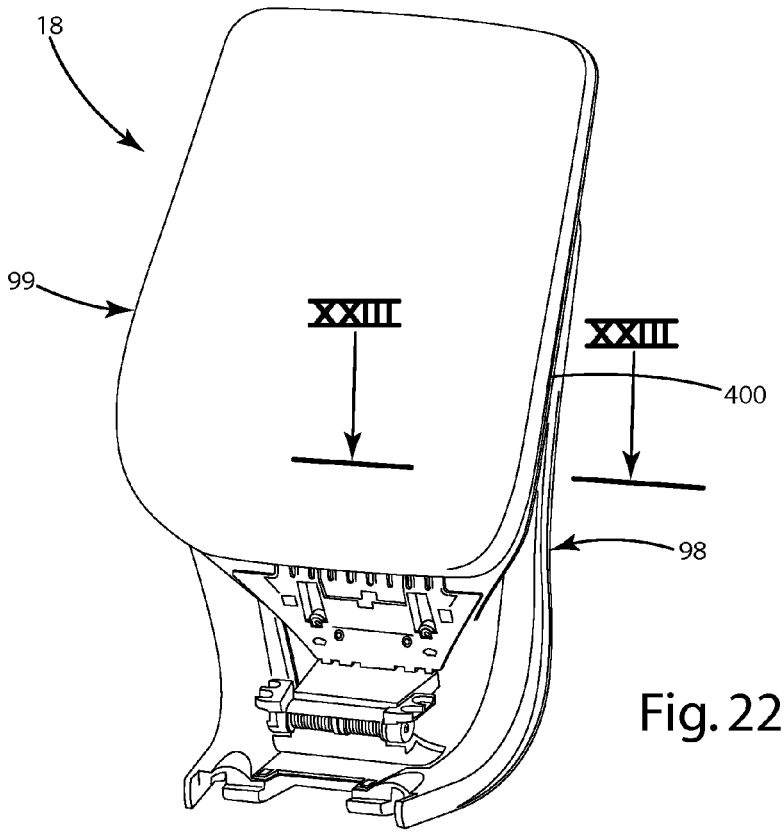
FIG. 22 is a perspective view of the back assembly.
Figure 23:
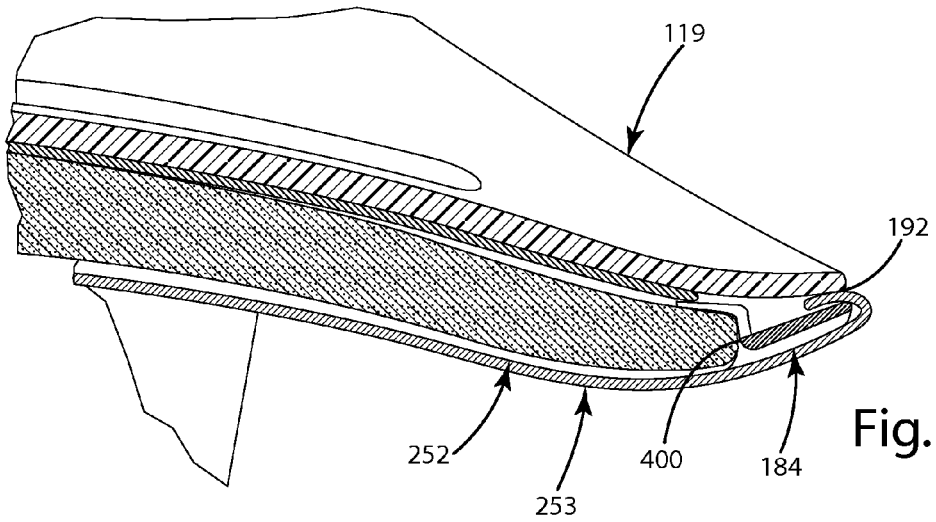
FIG. 23 is a cross-sectional top view of the back assembly, taken along the line XXIII-XXIII, FIG. 22.

As best illustrated in FIGS. 22 and 23, the back assembly 18 is further configured to increase the comfort of the outer edges of the back support assembly 99 and improve the aesthetics thereof. Specifically, the flexibly resilient comfort member 184 includes a recessed pocket 400 that receives the cushion member 252 therein, such that the outer edge of the cushion member 252 is spaced inwardly from the outer edge of the comfort member 184, thereby providing an aesthetically clean appearance to the outer peripheral edge of the overall back support assembly 99.

As noted above, the back assembly 18 (FIG. 4) is reclinable between an upright position E and a reclined position F. During recline, a gap 402 opens between the top frame portion 100 of the frame assembly 98 and the lower edge 127 of the second portion 123 of the back shell 112, as a result of flexure of the back support assembly 99 and pivoting of the back support assembly 99 about the pivot axis 182 in the direction 180. In the illustrated example, a shield member 406 (FIGS. 12 and 24) prevents access to the gap 402, thereby reducing or eliminating a potential pinch-point for the user. The shield member 406 includes a body portion 408 secured to a rear surface of the first portion 119 of the back shell 112 by a plurality of screws 410 received within rearwardly-extending bosses 412 of the shield member 406. The shield member 406 further includes an arcuately-shaped, downwardly concave engagement portion 414 that slideably tracks along the horizontal portion 100 of the frame assembly 98 and the center portion 158 of the race member 144 as the back assembly 18 is reclined and the back support assembly is flexed.

Figure 25:
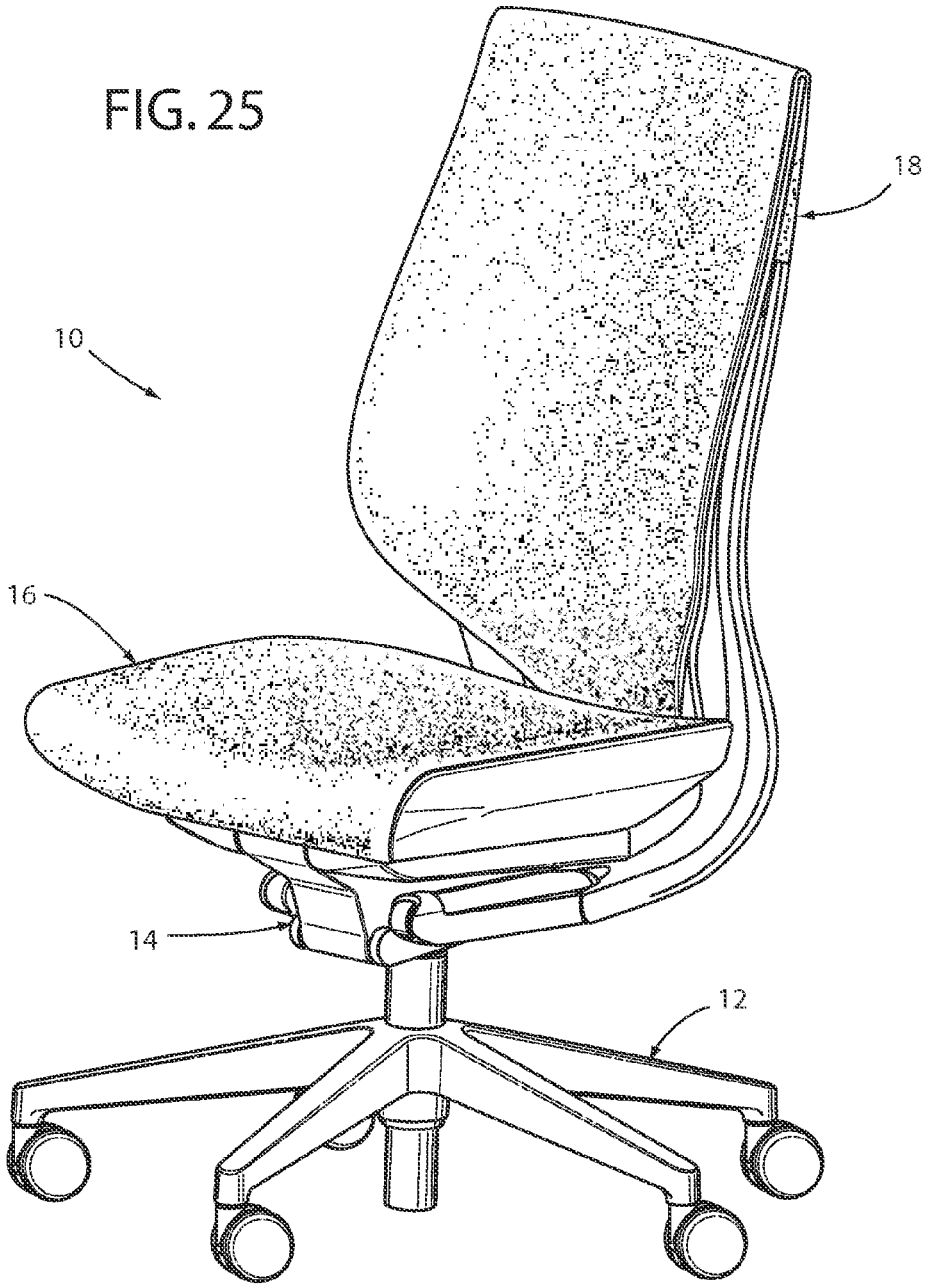
FIG. 25 is a perspective view of a chair assembly.
Figure 26:
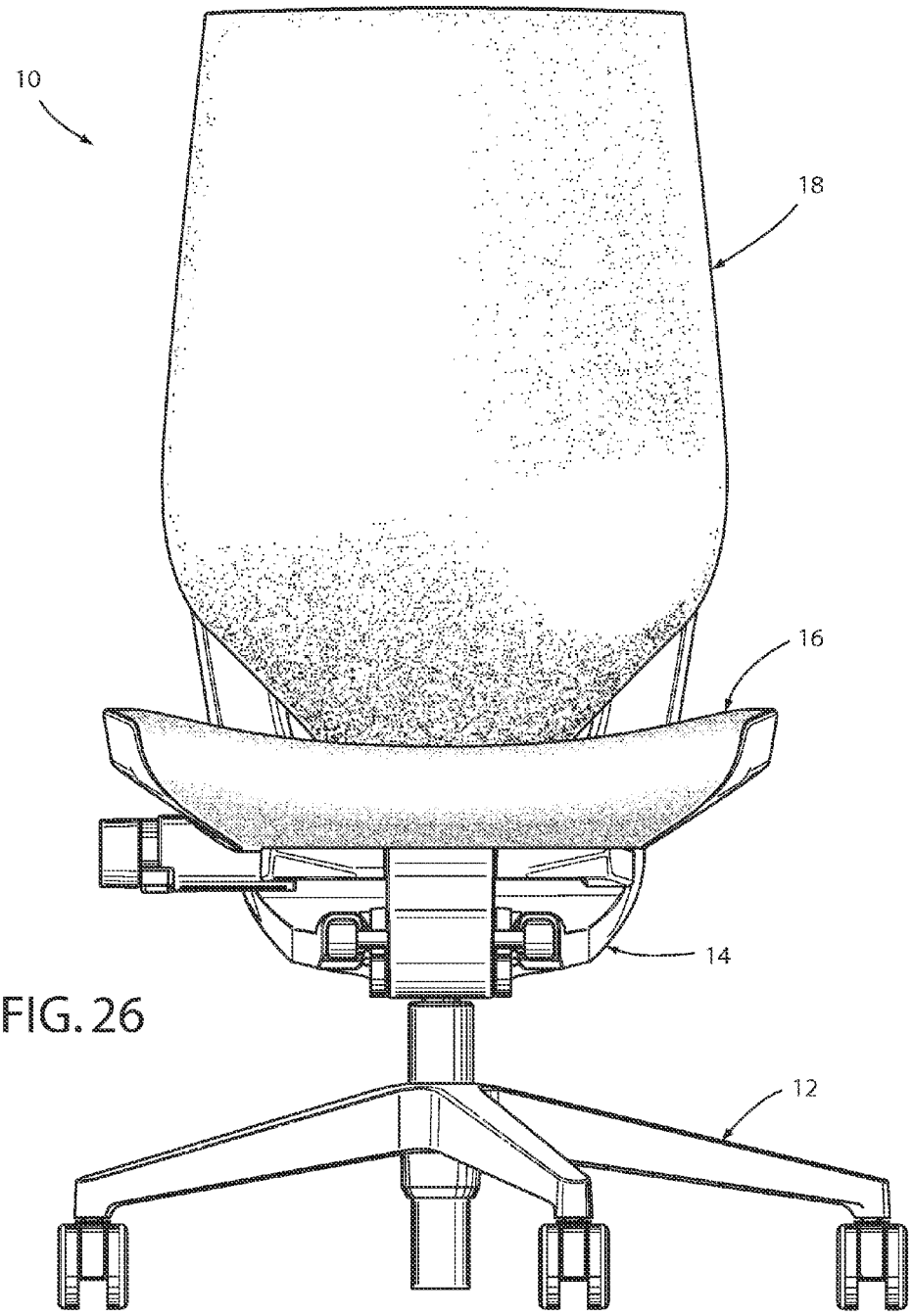
FIG. 26 is a front elevational view of the chair assembly of FIG. 25.
Figure 27:
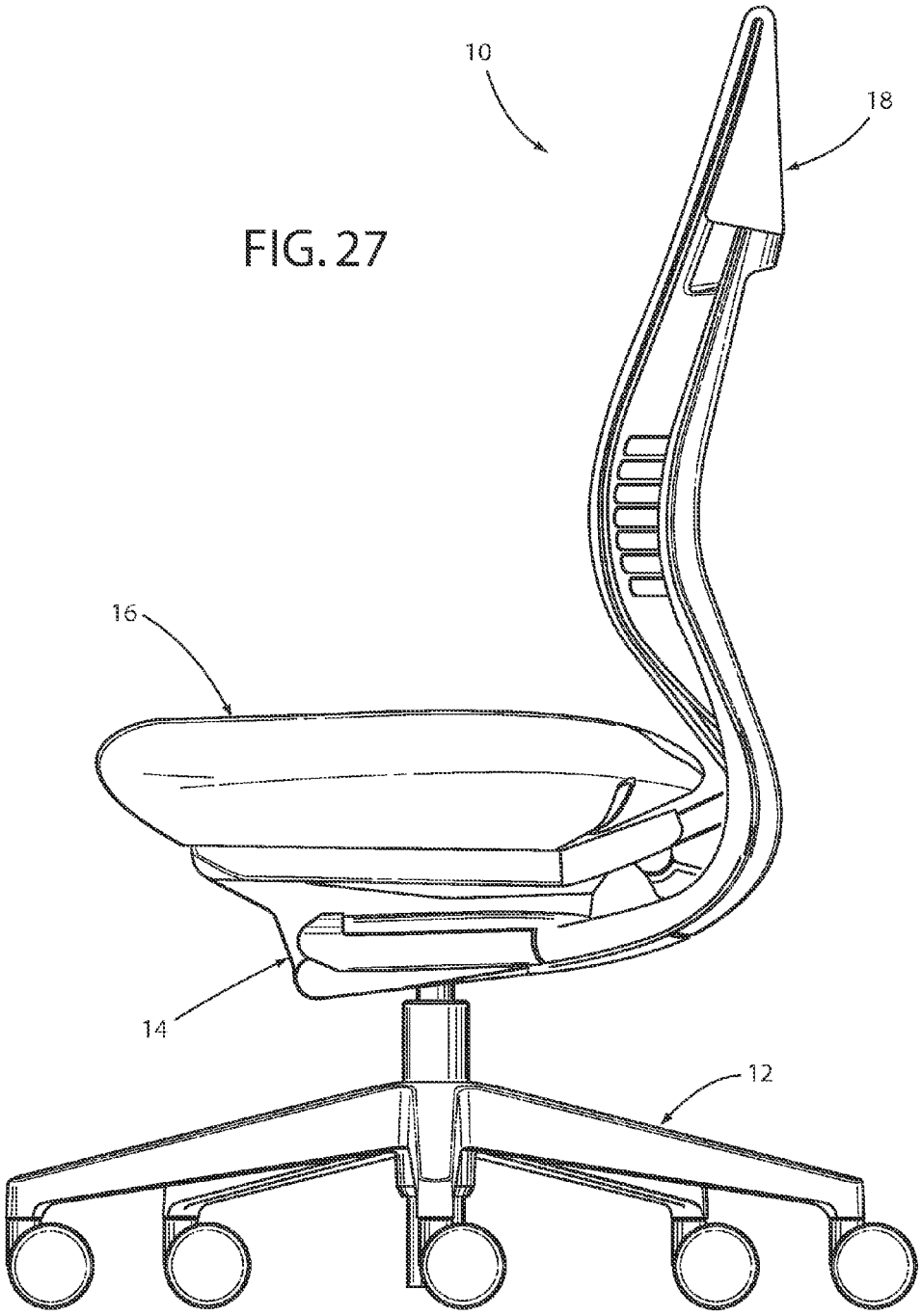
FIG. 27 is a first side elevational view of the chair assembly of FIG. 25.
Figure 28:
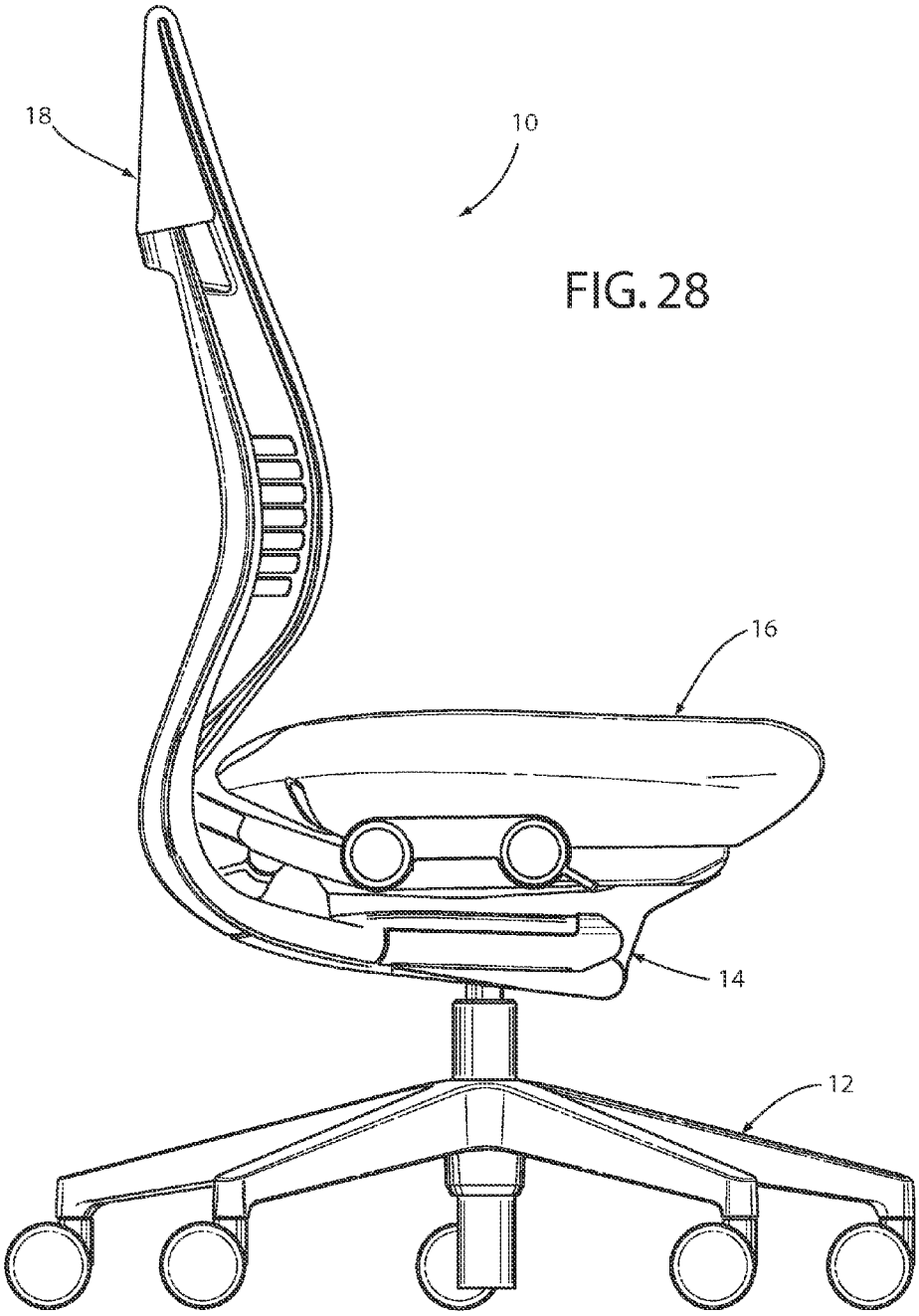
FIG. 28 is a second side elevational view of the chair assembly of FIG. 25.
Figure 29:
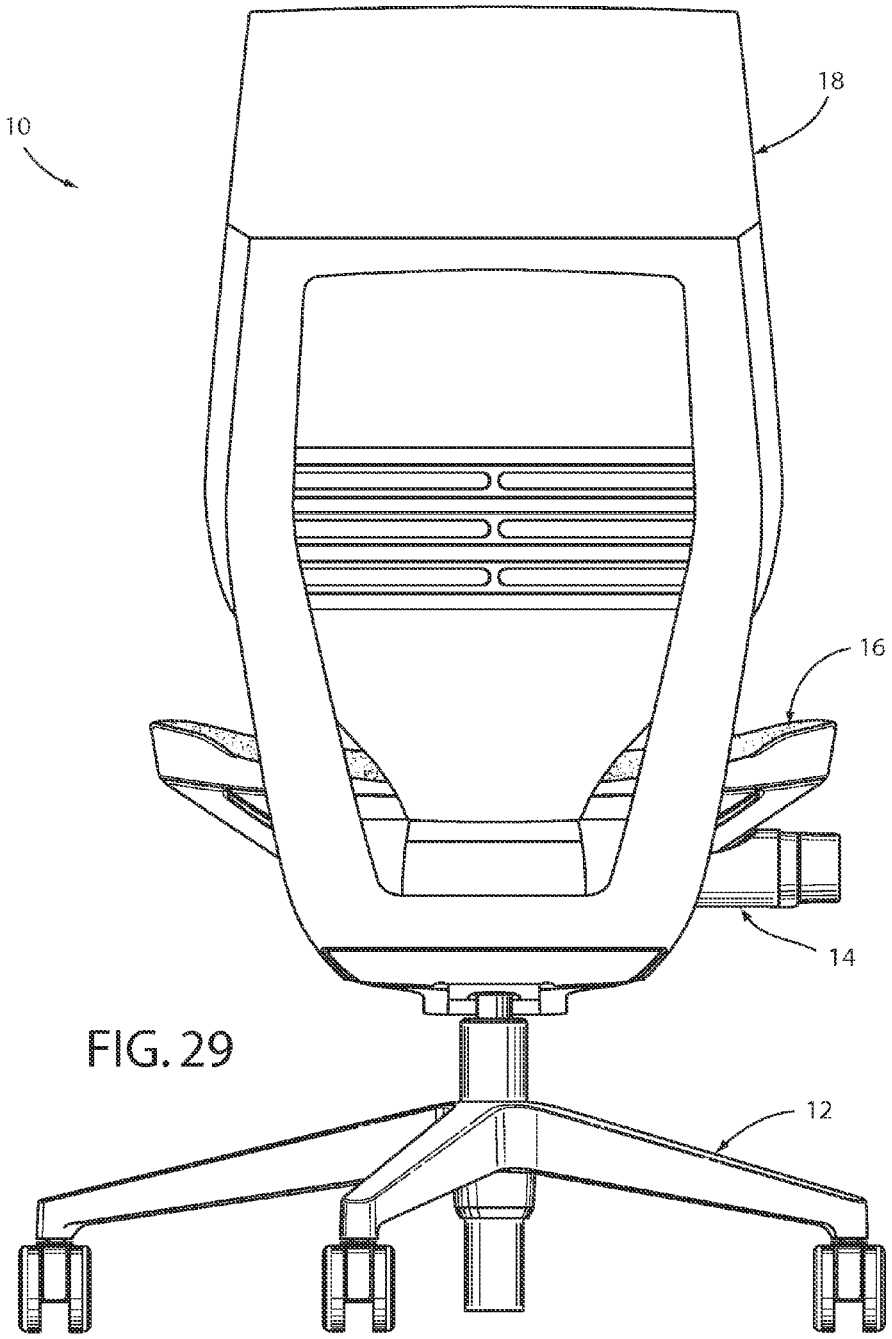
FIG. 29 is a rear elevational view of the chair assembly of FIG. 25.
Figure 30:
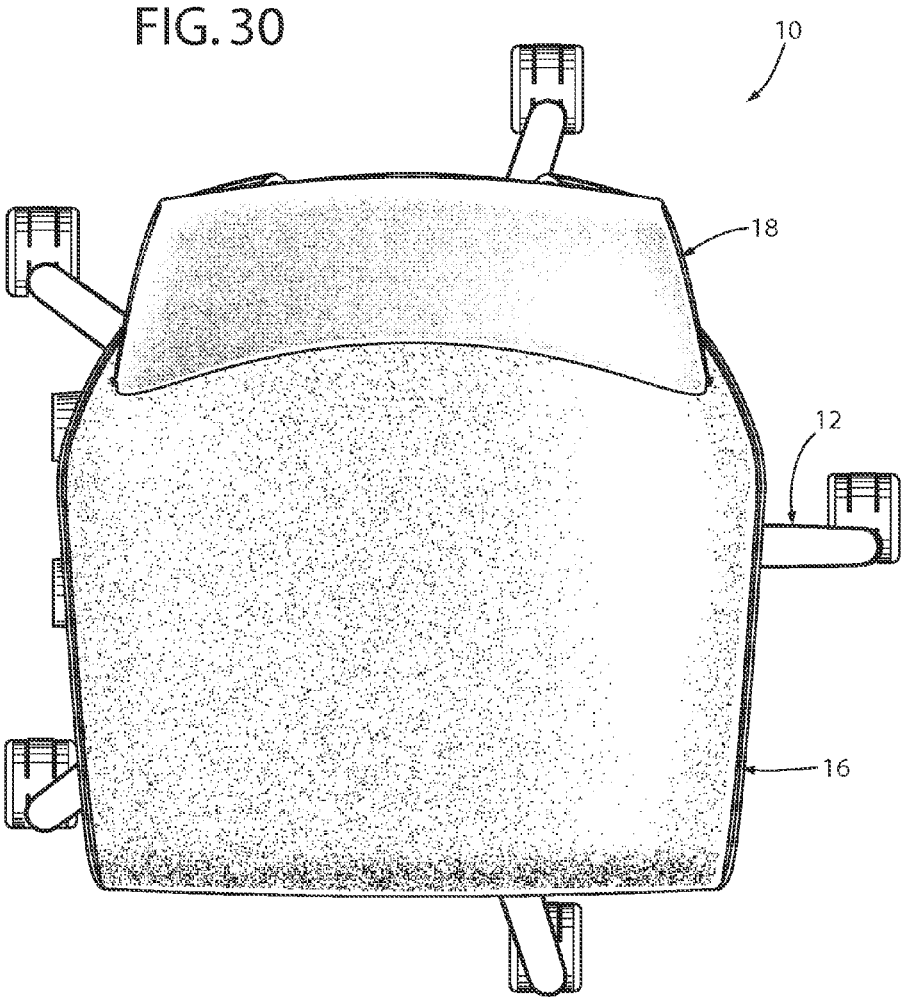
FIG. 30 is a top plan view of the chair assembly of FIG. 25.
Figure 31:
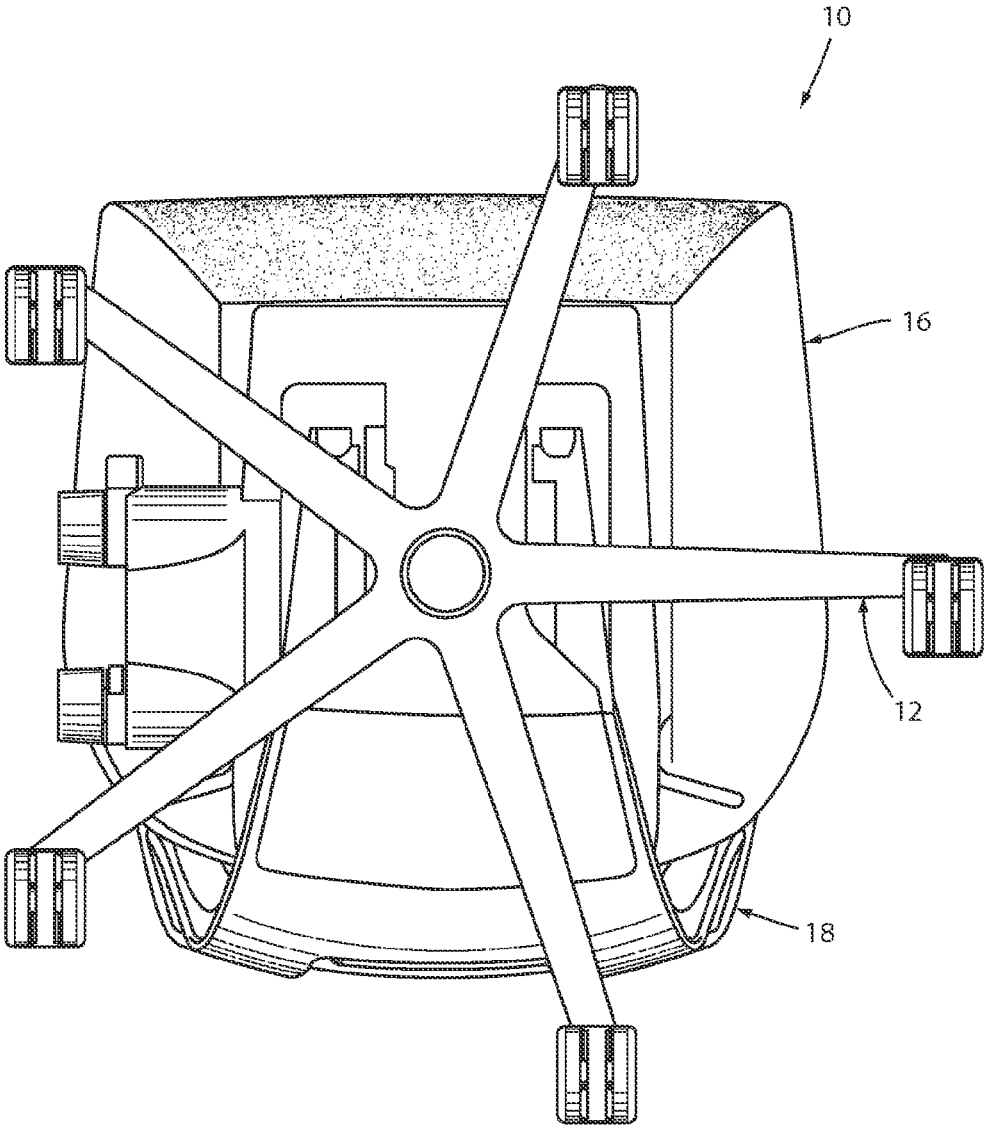
FIG. 31 is a bottom plan view of the chair assembly of FIG. 25.

A chair assembly embodiment is illustrated in a variety of views, including a perspective view (FIG. 25), a front elevational view (FIG. 26), a first side elevational view (FIG. 27), a second side elevational view (FIG. 28), a rear elevational view (FIG. 29), a top plan view (FIG. 30), and a bottom plan view (FIG. 31).

In the foregoing description, it will be readily appreciated by those skilled in the art that alternative combinations of the various components and elements of the invention and modifications to the invention may be made without departing from the concepts of the original invention when the concept is disclosed, such as applying the inventive concepts as disclosed herein to vehicle seating, stadium seating, home seating, theater seating and the like. Such modifications are to be considered as included in the following claims, unless these claims by their language expressly state otherwise.

The invention claimed is:

1. A chair component, comprising:

a first chair member adapted to support a seated user, and that includes a front surface and a rear surface that define a first thickness therebetween, the first chair member further includes at least one raised portion extending rearwardly from the rear surface, wherein the front surface and the at least one raised portion define a second thickness therebetween that is greater than the first thickness, and wherein a majority of the first chair member comprises the first thickness;

a cover member wrapped about at least a portion of the first chair member; and a drawstring operably coupled with the cover member to draw the cover member about the at least a portion of the first chair member, wherein the drawstring is secured to the first chair member by at least one fastener that is received within the at least one raised portion, and wherein the at least one fastener is separate from the first chair member and is securely retained to the at least one raised portion.

2. The chair component of claim 1, wherein the cover member is aligned with the at least one raised portion to properly align the cover member with respect to the first chair member.

3. The chair component of claim 2, wherein the at least one fastener includes at least one staple.

4. The chair component of claim 1, further comprising:

a second chair member movable between a first position, wherein the second portion is substantially coplanar with the first chair member, and a second position, wherein the second chair member is substantially parallel with the first chair member.

5. The chair component of claim 4, wherein the cover member is wrapped about at least a portion of the second chair member.

6. The chair component of claim 5, wherein the drawstring is operably coupled with the cover member to draw the cover member about the at least a portion of the second chair member, and wherein the drawstring is continuous.

7. The chair component of claim 4, wherein the first chair member includes at least one first coupler and the second chair member includes at least one second coupler that engages the first coupler, thereby securing the second chair member to the first chair member when the second chair member is in the second position.

8. The chair component of claim 7, wherein the at least one first coupler and the at least one second coupler comprise a quick-connect fastener.

9. The chair component of claim 4, wherein the second chair member comprises a back seat shell.

10. The chair component of claim 1, wherein the cover member includes a fabric portion and a drawstring tunnel located proximate an edge of the fabric portion, wherein the drawstring is received within the drawstring tunnel.

11. The chair component of claim 10, wherein the drawstring tunnel and the drawstring are secured to a rear surface of the first chair member by the at least one fastener.

12. The chair component of claim 10, wherein the fabric is elastically deformable in at least one direction.

13. The chair component of claim 1, wherein the component comprises a chair back assembly.

14. A chair component, comprising:

a chair member adapted to support a seated user and that includes a front surface and a rear surface, the first chair member further including at least one raised portion extending rearwardly from the rear surface;

a cover member wrapped about at least a portion of the first chair member; and a drawstring operably coupled with the cover member to draw the cover member about the at least a portion of the first chair member, wherein the cover is aligned with the at least one raised portion, and wherein the drawstring is secured to the first chair member, and wherein the at least one fastener is separate from the first chair member and is securely retained to the at least one raised portion.

15. The chair component of claim 14, wherein the drawstring is secured to the first chair member by at least one fastener that is received within the raised portion.

16. The chair component of claim 15, wherein the front surface and the rear surface define a first thickness therebetween, and wherein the front surface and the at least one raised portion define a second thickness therebetween that is greater than the first thickness.

17. The chair component of claim 15, wherein the at least one fastener includes at least one staple.

18. The chair component of claim 14, wherein the cover member includes a fabric portion and a drawstring tunnel located proximate an edge of the fabric portion, wherein the drawstring is received within the drawstring tunnel.

19. The chair component of claim 18, wherein the drawstring tunnel and the drawstring are secured to a rear surface of the first chair member by at least one fastener.

20. The chair component of claim 14, wherein the chair component comprises a chair back assembly.

* * * * *